US007956821B2

(12) United States Patent
Ikeno et al.

(10) Patent No.: US 7,956,821 B2
(45) Date of Patent: Jun. 7, 2011

(54) LIQUID CRYSTAL DISPLAY UNIT AND SYSTEM INCLUDING A PLURALITY OF STACKED DISPLAY DEVICES, AND DRIVE CIRCUIT

(75) Inventors: Hidenori Ikeno, Kanagawa (JP); Takashi Yatsushiro, Kanagawa (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 886 days.

(21) Appl. No.: 11/873,605

(22) Filed: Oct. 17, 2007

(65) Prior Publication Data

US 2008/0088649 A1 Apr. 17, 2008

(30) Foreign Application Priority Data

Oct. 17, 2006 (JP) ..... 2006-282448
Oct. 15, 2007 (JP) ..... 2007-268117

(51) Int. Cl.
*G09G 5/00* (2006.01)

(52) U.S. Cl. ..... 345/4; 345/1.1

(58) Field of Classification Search ..... 345/87, 345/88, 89, 1.1, 1.2, 1.3, 4, 3.1, 5, 690, 103
See application file for complete search history.

(56) References Cited

U.S. PATENT DOCUMENTS 4,562,433 A * 12/1985 Biferno ..... 345/4
5,371,618 A * 12/1994 Tai et al. ..... 349/78
6,803,949 B1 * 10/2004 Kitagawa ..... 348/223.1
2006/0079031 A1 4/2006 Uchida
2006/0125745 A1 * 6/2006 Evanicky ..... 345/84
2006/0290594 A1 * 12/2006 Engel et al. ..... 345/4

FOREIGN PATENT DOCUMENTS

JP 2006-114523 4/2006

* cited by examiner

*Primary Examiner* — Ricardo L Osorio
(74) *Attorney, Agent, or Firm* — Young & Thompson

(57) ABSTRACT

LCD unit includes first and second LCD panels stacked one on another. An image-data processing unit outputs monochrome image data to the second LCD panel, and color image data to the first LCD panel. The monochrome image data specifies a full transmission for a pixel having a luminance not less than a threshold, the original gray-scale level for a pixel having a luminance less than the threshold. The color image data is generated based on the monochrome image data and input image data.

29 Claims, 10 Drawing Sheets

LIQUID CRYSTAL DISPLAY UNIT AND SYSTEM INCLUDING A PLURALITY OF STACKED DISPLAY DEVICES, AND DRIVE CIRCUIT

This application is based upon and claims the benefit of priority from Japanese patent application Nos. 2006-282448 and 2007-268117, the disclosure of which is incorporated herein in its entirety by reference.

BACKGROUND OF THE INVENTION (a) Field of the Invention

The present invention relates to a liquid crystal display (LCD) unit and a LCD system and, more particularly, to LCD unit and system including a stacked LCD devices. The present invention also relates to a drive circuit for driving such a LCD unit or LCD system.

(b) Description of the Related Art

LCD units have the advantages of lower power dissipation and higher definition, and thus are used from a portable cellular phone to a large-screen monitor TV. The contrast ratio of a LCD device or LCD panel alone in the LCD unit is at most around 1000:1 in a dark environment, and thus is inferior to the contrast ratio of a CRT (cathode ray tube) or discharge-type display panel, such as PDP (plasma display panel), FED (field emission display) and SED (surface-emission electron-emitter display). For example, the PDP, which is generally used as a monitor TV similarly to the LCCD unit, has a contrast ratio of 3000:1. Thus, the LCD unit has a problem in that when a video source, such as movie, having an abundant power of expression in a dark portion, is used for display of the image on the LCD unit, there is insufficient sense of presence on site.

To solve the above problem, a technique is proposed which controls the intensity of the backlight for the LCD unit based on the picture image to be displayed, without improving the contrast ratio of the LCD unit itself, to improve the contrast ratio of the LCD unit as a whole. However, in the LCD unit having a surface-emission light source, a cold cathode tube having a narrower dynamic range of luminance is generally used as the backlight source. This narrower dynamic range limits the contrast ratio of the LCD unit in the range of 2000:1 to 3000:1 at most even if the light intensity of the backlight unit is controlled based on the picture image to be displayed. In addition, since the cold cathode tube is of a rod or cylindrical shape, the light intensity cannot be controlled if the image includes a higher luminance portion and a lower luminance portion at the same time on the same screen. This limits the improvement of the contrast ratio by the luminance control of the backlight. More specifically, if a picture image having both higher and lower luminance portions is controlled particularly in consideration of reproducibility for the lower luminance portion, the effective contrast ratio is lowered.

In order not to incur the above problem, it is generally necessary to intensively raise the contrast ratio of the LCD panel itself in the LCD unit. However, as described before, the contrast ratio of the LCD panel itself is at most around 1000:1 even if the contrast ratio of the LCD panel itself is improved. Patent Publication Nos. JP-1989-10223A and JP-1984-189625A describe a technique for considerably improving the contrast ratio of the LCD unit without significantly improving the contrast ratio of the LCD panel itself. In this technique, a plurality of LCD panels or LCD devices are stacked one on another in a LCD unit, to thereby reduce the dark luminance and thus raise the overall contrast ratio of the LCD unit.

FIG. 12 shows the configuration of a LCD unit including two LCD panels (LCD devices) stacked one on another. The LCD unit includes, as viewed from the light-incident side, polarizing film 901, LCD panel 941, polarizing film 902, LCD panel 942, and polarizing film 903, The LCD panel 941 includes a twisted-nematic mode (TN-mode) liquid crystal (LC) layer 931, and a pair of transparent substrates 911 and 912 each having transparent electrode or electrodes 921, 922 on the surface of the transparent substrate near the LCD layer 931. The LCD panel 942 includes a TN-mode LC layer 932, and a pair of transparent substrates 913 and 914 each having transparent electrode or electrodes 923, 924 on the surface of the transparent substrate near the LC layer 932. The transparent electrodes 921 and 923 are pixel electrodes to which a drive signal is supplied from a drive circuit 951, whereas the transparent electrodes 922 and 924 are common electrodes This configuration of the LCD unit provides an improvement of the contrast ratio from around 10:1 or 15:1 up to around 100:1. A LCD unit including three LCD panels having a similar structure may have a contrast ratio of around 1000:1. In short, the LCD unit having a plurality of LCD panels has a contrast ratio which exceeds the limit of the contrast ratio achieved by a single LCD panel.

In the LCD unit described in JP-1989-10223A, the higher contrast ratio is achieved by driving two LCD panels 941 and 942 by using the same drive signal supplied from a single video source. In this configuration, the distance between the LCD panel 931 and the LCD panel 932 as viewed in the thickness direction thereof provides a deviation of the location therebetween, when the display unit is observed in a slanted direction slanted from the perpendicular of the LCD panels. The deviation of location incurs a sense of discomfort to an observer observing the LCD unit in the slanted direction, due to the abnormal image or double-line image. In addition, there may be a case wherein light passes through both the LCD panels at different positions or at different color filters in the slanted direction, to thereby reduce the luminance and thus degrade the visibility of image by the observer.

SUMMARY OF THE INVENTION

In view of the above problem in the conventional technique, it is an object of the present invention to provide a LCD unit and a LCD system including a plurality of LCD panels stacked one on another and providing an improved visibility to the observer observing the LCD unit in a slanted viewing direction.

It is another object of the present invention to provide a drive circuit for driving the LCD unit or LCD system of the present invention.

The present invention provides, in a first aspect thereof, a liquid crystal display (LCD) system including: a LCD unit displaying a color image and including a plurality (n) of LCD panels stacked one on another; and an image-data processing unit for generating image data based on input data to drive the LCD unit, the plurality of LCD panels including: a first LCD panel including a color filter layer; and a second LCD panel including no color filter layer, the image-data processing unit including: a monochrome-image generation section for generating monochrome image data based on the input image data to output the monochrome image data to the second LCD panel, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the input image data and the monochrome image data to output the color image data to the first LCD panel.

The present invention provides, in a second aspect thereof, a liquid crystal display (LCD) device including: a LCD unit displaying a color image and including at least one LCD panel and a light source driven by a dot-matrix drive scheme; and an image-data processing unit receiving input image data to generate output image data for driving the LCD unit, the image-data processing unit including: a monochrome-image generation section for generating monochrome image data based on the input image data to output the monochrome image data to the light source, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the input image data and the monochrome image data to output the color image data to the LCD panel, the light source controlling luminance of each dot of pixel in the LCD panel based on the monochrome image data.

The present invention provides, in a third aspect thereof, liquid crystal display (LCD) system including: a LCD unit including a plurality of LCD panels stacked one on another; and an image-data processing unit for generating image data based on input image data to drive the LCD unit, the plurality of LCD panels including: a first LCD panel and a second LCD panel both including no color filter layer, the image-data processing unit including: a monochrome-image generation section for generating monochrome image data based on the input image data to output the monochrome image data to the second LCD panel, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-sale level of the second pixel specified in the input image data; and a color-image generation section for generating color image data based on the input image data and the monochrome image data to output the color image data to the first LCD panel.

The present invention provides, in a fourth aspect thereof, a liquid crystal display (LCD) system including: a LCD unit including a plurality (n) of LCD panels stacked one on another; an image source unit for generating intermediate image data based on an image source; and an image-data processing unit for generating image data based on the intermediate image data to drive the LCD unit, the plurality of LCD panels including: a first LCD panel including a color filter layer and a second LCD panel including no color filter layers, the image-data processing unit including: a monochrome-image generation section for generating monochrome image data based on the intermediate image data to output the monochrome image data to the second LCD panel, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the intermediate image data and the monochrome image data to output the color image data to the first LCD panel.

The present invention provides, in a fifth aspect thereof, a drive circuit for driving a liquid crystal display (LCD) unit including a first LCD device, a second LCD device and a light source arranged in this order from a light emitting side of the LCD unit, the first LCD device including a first LCD panel sandwiched between a pair of first polarizing films, the second LCD device including a second LCD panel sandwiched between a pair of second polarizing films. One of the first polarizing films near the second LCD panel and one of the second polarizing films near the first LCD panel having optical axes parallel to one another or being configured by a common polarizing film, wherein:

the drive circuit includes a single input port set for receiving therethrough input image data, an image-data processing unit for generating two sets of output image data by using different algorithms of image processing, and two output port sets for delivering therethrough two sets of output image data for respectively driving the first and second LCD devices.

The above and other objects, features and advantages of the present invention will be more apparent from the following description, referring to the accompanying drawings.

BRIEF DESCRIPTION OF THE DRAWINGS

FIGS. 4A and 48 are graphs showing the relationship between the chromaticity and the transmittance in the case of two LCD panels and a single LCD panel, respectively.

FIGS. 10A to 10C each show an image of bright area on the screen, wherein FIG. 10A shows the luminance of the original image, FIG. 10B shows the luminance obtained by weighted-averaging using a weighting coefficient following the Gaussian distribution, and FIG. 10C shows the luminance obtained by weighted-averaging and subsequent clipping and enlargement of a histogram.

PREFERRED EMBODIMENT OF THE INVENTION

Now, exemplary embodiments of the present invention will be described with reference to accompanying drawings.

Figure 1:
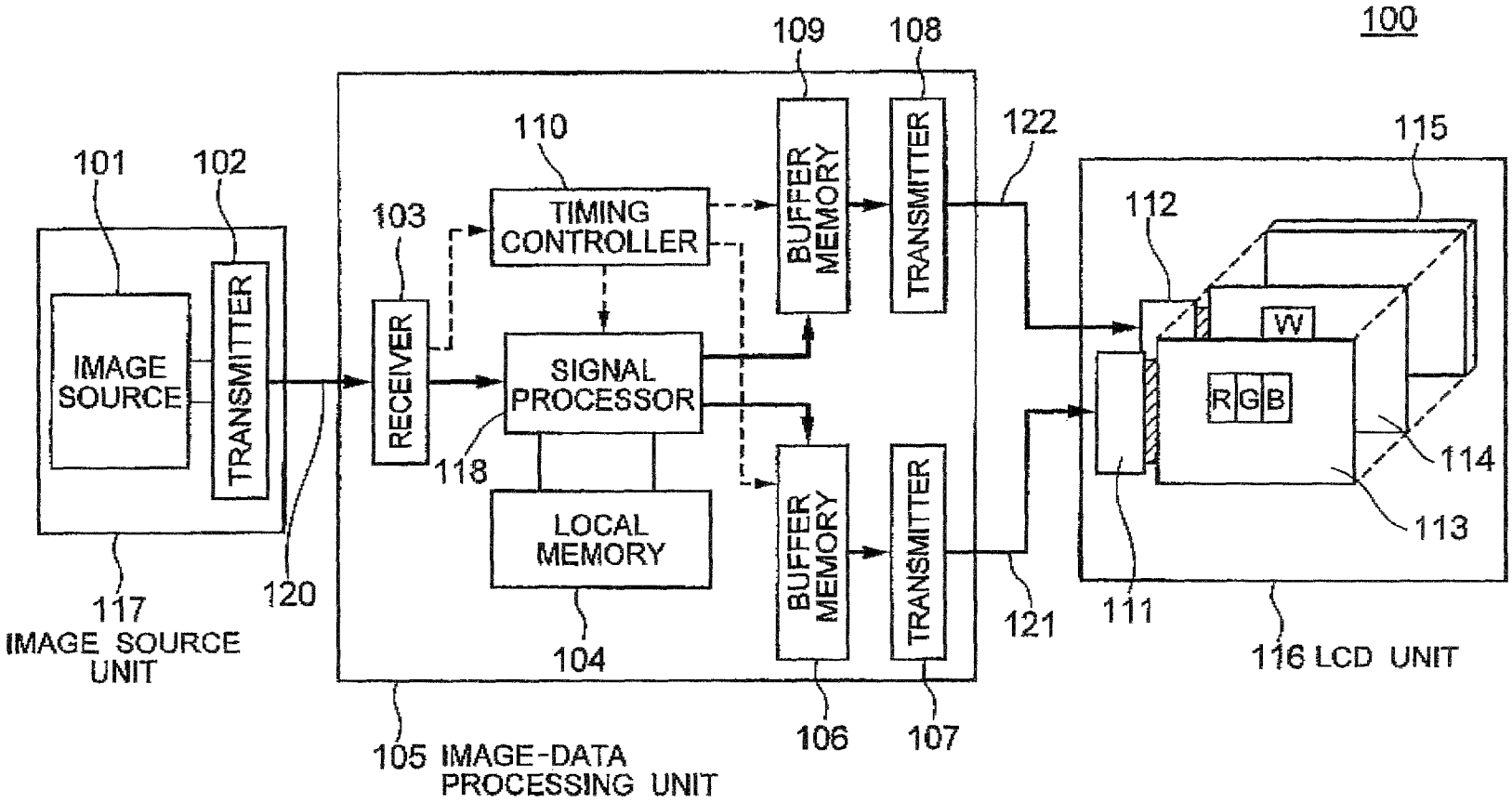
FIG. 1 is a block diagram of a LCD system according to a first exemplary embodiment of the present invention.

FIG. 1 shows a LCD system according to a first exemplary embodiment of the present invention. The LCD system, generally designated at numeral 100, includes an image source unit 117, an image-data processing unit 105 and a LCD unit 116 which are connected together via signal cables 120 to 122.

The image source unit 117 includes an image source 101 and a transmitter 102. The transmitter 102 transforms or converts the image data supplied from the image source 101 into video signals suited for transmission, and transmits the same to the image-data processing unit 105. The transmitter 102 may be configured by, for example, THC63DV164 (trademark) supplied from Xilinc Corp. The transmitter 102 converts parallel data output from the image source 101 into a serial signal, and transmits the same to the image-data processing unit 105 via a telecommunication cable 120.

The transmitter 102 may be any type interface such as used for personal computers, so long as the transmitter can deliver general DVI outputs. The image source unit 117 may be a personal computer which provides DVI outputs. The signal transmission may use any format such as analog or digital signal format other than the DVI format so long as it is exchanged between the transmitter 102 and the receiver 103.

The image-data processing unit 105 includes receiver 103, local memory 104, buffer memories 106 and 109, transmitters 107 and 108, timing controller 110, and signal processor 118. The LCD unit 116 includes two or more LCD panels and a light source 115. The image-data processing unit 105 performs signal conversion of the image signal delivered from the image source unit 117 to generate a drive signal for driving the LCD panels 113 and 114 in the LCD unit 116. The signal generated by the image-data processing unit 105 is delivered to the drive circuits 111, 112 in the LCD devices 113 and 114 via signal cables 121 and 122, respectively.

The image-data processing unit 105 may be a Spartan-3E (trademark) display solution board supplied from Xilinc Corp., to which a DVI I/F board configuring a receiver 103 is connected. The other blocks of the image-data processing unit 105 may be configured by the Spartan-3E display solution board, wherein the image processor 118 is configured by FPGA chip (Spartan-3E) provided in this board. The signal delivered from the transmitters 107 and 108 is in a format of LVDS of the LCD panels, for example. The details of image processing performed in the image-data processing unit 105 will be discussed later.

The LCD unit 116 includes first LCD device 113 and second LCD device 114 stacked one on another, and a backlight source 115 disposed on the rear side of the LCD unit 116 far from the observer. The first LCD device 113 includes a color LCD panel, and the second LCD device 114 includes a monochrome LCD panel. The image-data processing unit 105 provides different video signals to the drive circuit 111 of the first LCD device 113, and drive circuit 112 of the second LCD device 114. These LCD devices 113, 114 are separately driven by the drive signals input to the drive circuits 111, 112.

Figure 2:
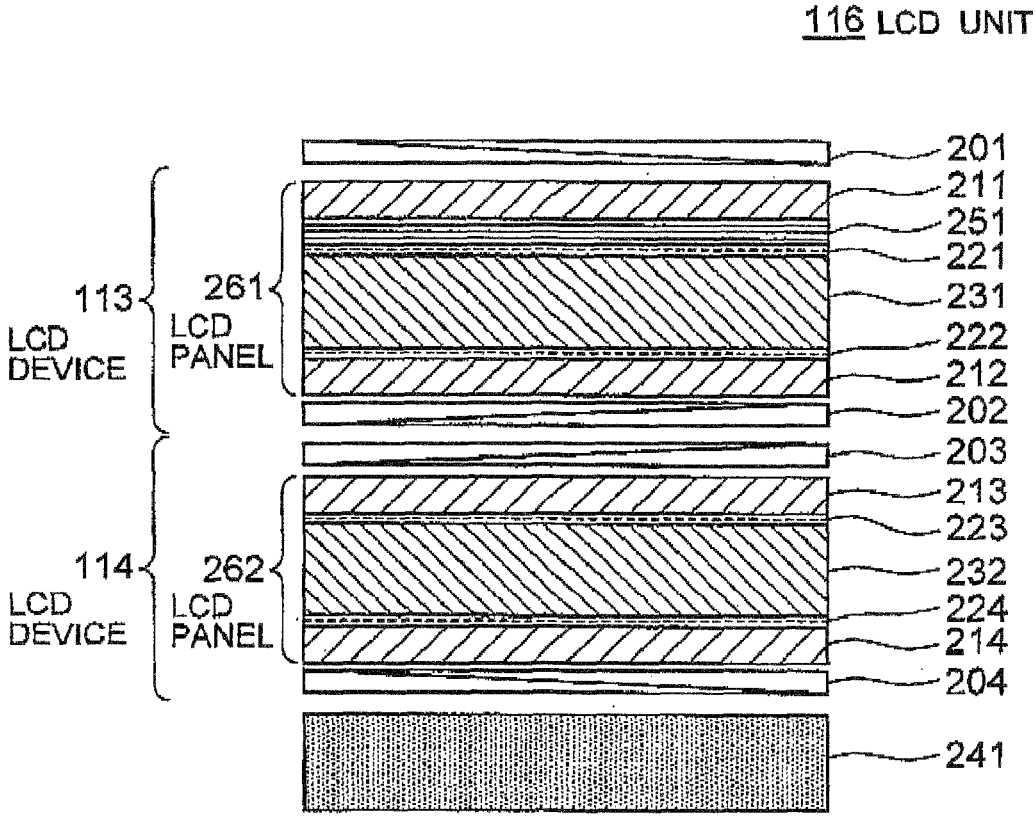
FIG. 2 is a schematic sectional view or the LCD unit in the LCD system of FIG. 1.

FIG. 2 shows the sectional structure of the LCD unit 116. The LCD unit 116 includes polarizing film 201, transparent substrate 211, color filter layer 251, alignment film 221, LC layer 231, alignment film 222, transparent substrate 212, polarizing film 202, polarizing film 203, transparent substrate 213, alignment film 223, LC layer 232, alignment film 224, transparent substrate 214, and polarizing film 204, which are arranged in this order from the light emitting side or front side of the LCD unit 116. Hereinafter, for the sake of convenience of description, a combination of the transparent substrate 211, color filter layer 251, alignment film 221, LC layer 231, alignment film 222, and transparent substrate 212 is referred to as a first LCD panel 261, whereas a combination of the LCD panel 261, polarizing film 201 and polarizing film 202 associated with the LCD panel 261 is referred to as a first LCD device 113. Similarly, a combination of the transparent substrate 213, alignment film 223, LC layer 232, alignment film 224, and transparent substrate 214 is referred to as a second LCD panel 262, whereas a combination of the LCD panel 262, polarizing film 203 and polarizing film 204 associated with the LCD panel 262 is referred to as a second LCD device 114.

The surface-emission light source 241 shown in FIG. 2 corresponds to the light source 115 in FIG. 1. The surface-emission light source 241 irradiates the rear side of the first LCD device 113 and second LCD device 114. The light emitted from the surface-emission light source 241 penetrates the second LCD device 114 and first LCD device 113 to be observed by the observer at the front side of the LCD unit 116. Control of the transmission of the light on the first and second LCD devices 113, 114 allows the observer to observe an image on the screen of the LCD unit 116.

On the surface of the transparent substrate 212 near the LCD layer 231, an array of electrodes are formed in association with respective three-terminal control devices such as TFTs. A pixel electrode and a corresponding TFT in combination configure a pixel The LCD device is of a lateral-electric-field mode such as an in-plane-switching (IPS) mode, wherein each pixel includes therein a comb-teeth pixel electrode and a comb-teeth common electrode for generating a lateral electric field in the LC layer, In the color filter layer 251, red (R), green (G) and blue (B) color filters in a shape of stripe are arranged so that a single pixel includes three sub-pixels (dots) including R, G and B stripes.

A process for manufacturing the LCD device will be described hereinafter. An alignment films 221 is formed on the surface of the transparent substrate 211 on which an array of electrodes are arranged, whereas an alignment film 22 is formed on the surface of the transparent substrate 212 on which the color filter layer 251 is formed. The alignment films 221, 222 are then subjected to an alignment treatment such as a rubbing treatment. Both the transparent substrates 211, 212 are assembled so that the alignment films formed on the transparent substrates oppose each other with a gap therebetween and that the directions of the alignment treatment are parallel to each other The gap is then filled with liquid crystal, ZLI4792 (trademark) supplied from Merck Co., whereby the first LCD panel 261 is obtained. The polarizing film 201 and polarizing film 202 using SEG1224 (trademark) supplied from Nitto Denko Co. are attached onto the LCD panel 261 for sandwiching therebetween the LCD panel 261, to thereby obtain the first LCD device 113. In this step, the polarizing films 201, 202 are arranged so that the light transmission axes or absorbing axes thereof are perpendicular to one another and that the light transmission axis or absorbing axis of one of the polarizing films is parallel to the alignment direction of the LC layer.

The second LCD panel 262 is manufactured similarly to the first LCD panel 261 except that the transparent substrate 213 does not include color filter layer. An array of electrodes are formed in association with respective TFTs on the side of the transparent substrate 214 near the LC layer 232. In addition, the pixel of the second LCD panel 262 includes no sub-pixels because of absence of the color filter layer on the second LCD panel 262. In an alternative, the second LCD panel 262 may have a pixel having a size corresponding to the size of the sub-pixels in the first LCD panel 261. The second LCD panel 262 is sandwiched between the polarizing films 203, 204, the arrangement of which is similar to that of the first LCD device 113, to obtain the second LCD device 114.

The first LCD device 113 and second LCD device 114 thus manufactured are then stacked one on another to obtain the LCD unit 116. In this step, the surface-emission light source 241 is arranged on the rear side of the LCD unit 116, and the alignment directions of both the LCD devices 113, 114 are parallel to or perpendicular to one another. In addition, the light transmission or absorbing axes of both the polarizing films 202, 203 are made substantially parallel to one another so that the light passed by the polarizing film 203 passes the polarizing film 202 as much as possible.

The LCD unit 116 includes a single polarizing film 251 in the two LCD devices 113, 114, whereby the observer observing in a slanted viewing direction does not recognize double color layers, and thus does not perceive a different luminance occurring depending on the viewing direction In the present embodiment, the two LCD devices are driven by different drive signals as described above. If both the LCD devices are driven by the same drive signal, the distance between the LCD devices incurs a sense of discomfort due to the parallax between the LCD devices.

Figure 3:
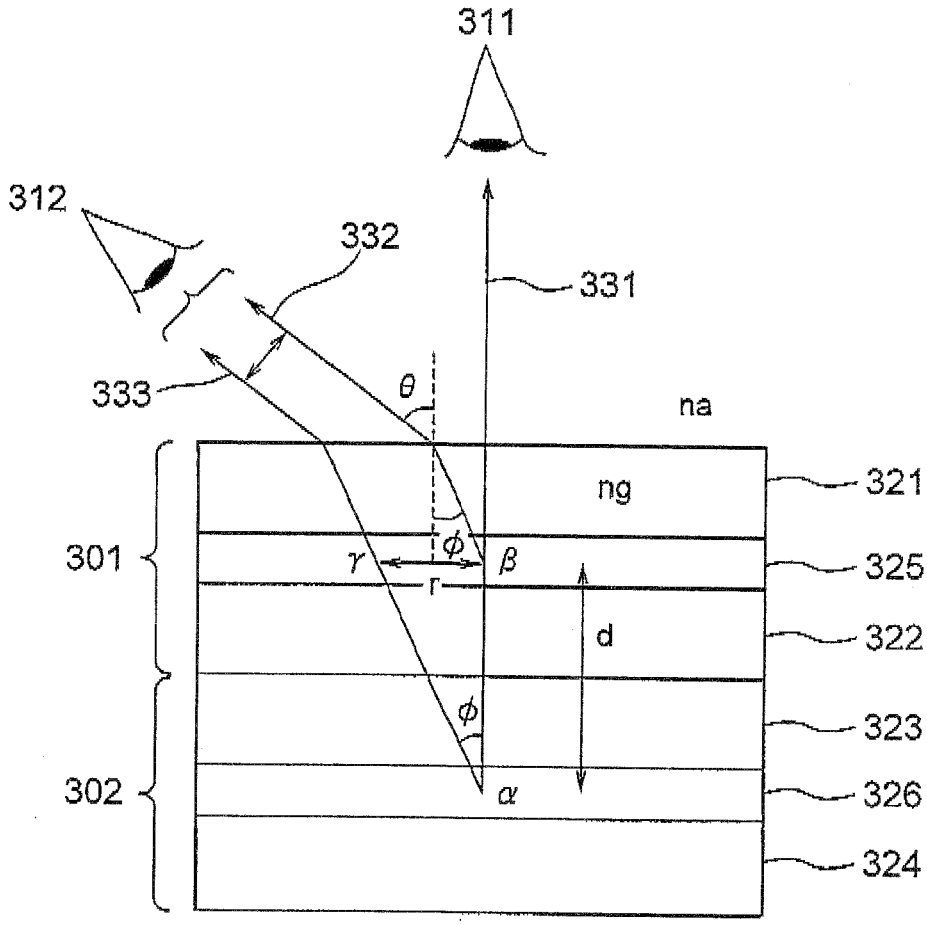
FIG. 3 is an explanatory sectional view showing the LCD unit of FIG. 2 and the light traveling within the LCD unit.

FIG. 3 schematically shows a situation of generation of the parallax in a comparative technique, wherein only the transparent substrates and LC layers are illustrated for a simplification purpose, LCD devices 301, 302 in FIG. 3 correspond to the LCD devices 113, 114, respectively, in FIG. 2, transparent substrates 321 to 324 correspond to the transparent substrates 211 to 214, respectively, and LC layers 325, 326 correspond to the LC layers 231, 232, respectively.

Observation of the first LCD device 301 and second LCD device 302 in the direction perpendicular to the screen surface allows a point β on the LC layer 325 of the first LCD device 301 and a point a on the LC layer 326 of the second LCD device 302 to overlap each other in a line of view 331, as viewed by an observer 311. More specifically, observation in the perpendicular direction does not cause any parallax which incurs a sense of discomfort to the observer.

On the other hand, observation in a slanted direction at an angle of θ with respect to the perpendicular to the screen surface allows the point α and point β to deviate from one another due to the distance "d" in the thickness direction between these points. The point α is observed in a line of view 332, whereas the point β is observed in a line of view 333 by the observer 312. More specifically, observation in the slanted direction causes both the points α and β to be observed at different locations, whereby an edge of the image may be observed as double lines on the screen.

The light passed by the first LCD device 301 and second LCD device 302 exits the transparent substrate 321 to the air while being deflected in the traveling direction based on the law of Snell depending on the difference in the refractive index. Assuming that θ, ϕ, "ng" and "na" are the outgoing angle of the light from the outer surface of the transparent substrate 321, incident angle of the light on the outer surface of the transparent substrate 321, refractive index of the transparent substrate 321 and refractive index of the air, respectively, the low of Snell provides the following relationship:

$$na \times \sin\theta = ng \times \sin\phi.$$

Change of the above expression provides the following relationship:

$$\phi = \sin^{-1}((na/ng) \times \sin\theta).$$

From the relationship of alternate-interior angle, the angle between the light traveling from the point β to the outer surface of the transparent substrate 321 and the perpendicular to the outer surface is also ϕ. Similarly, the angle between the light traveling from the point α to the outer surface of the transparent surface and the perpendicular is also ϕ. The deviation "r" between the point α in the second LCD device 301 and the point β on the first LCD device, as observed in the viewing angle θ, can be expressed by the following formula:

$$\tan\phi = (r/d) \tag{1}$$

$$r = d \times \tan\phi = d \times \tan(\sin^{-1}((na/ng) \times \sin\theta)).$$

For deleting the sense of parallax as observed in the slanted direction at angle θ, it is sufficient in principle o shift the position of data to be displayed on the point β by the distance r to the position γ. Thus, the signal processor 118 performs scattering of the data up to the distance r to conduct an averaging processing onto the entire pixel data on the screen This reduces the sense of parallax and reduces the sense of discomfort of the observer. The averaging processing is performed on the data for either one of the first and second LCD devices. In the view point of deleting the sense of parallax, the effect of the averaging processing is comparable whether the averaging processing is performed onto the data of first LCD device or the second LCD device, i.e., with or without a color filter layer. Similarly, the effect of the averaging processing is comparable whether the averaging processing is performed onto the front LCD device or the rear LCD device.

If the averaging processing is performed onto the data for the rear LCD device, an optical component having an optical dispersion property, such as an optical dispersion film, may be interposed between the front LCD device and the rear LCD devices to thereby increase the apparent distance "r'" for the averaging processing. The distance "r'" in such a case is obtained by the following formula:

$$r' = (d' \times \tan\phi) + ((d - d') \times \tan(\phi + \eta)),$$

where d' and η are the distance of the dispersion film from the second LCD layer 326, and half-value dispersion angle of the optical dispersion film. Thus, provision of the optical dispersion film increases the effective distance r' for the averaging processing. This fact should be considered for performing the averaging processing in the image-data processing unit 105.

The present inventors analyzed the driving scheme of the LCD unit including stacked LCD devices, and found that a superior image can be achieved by performing averaging processing onto the data for the second LCD device 302 without the color filter layer, performing a color display on the first LCD device 301 and stacking together both the first and second LCD devices. The reason for the superior image obtained by performing the averaging processing on the data for the second LCD device is such that the averaging processing on the data for the first LCD device 301 (113) causes an obscure color and narrows the range of reproducibility of chromaticity.

Figure 4B:
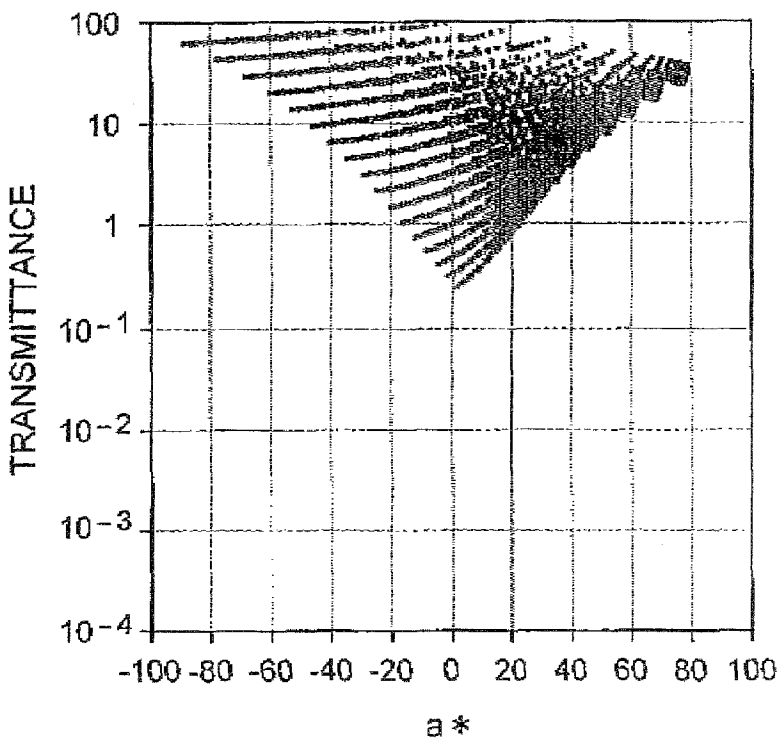
Figure 4A:
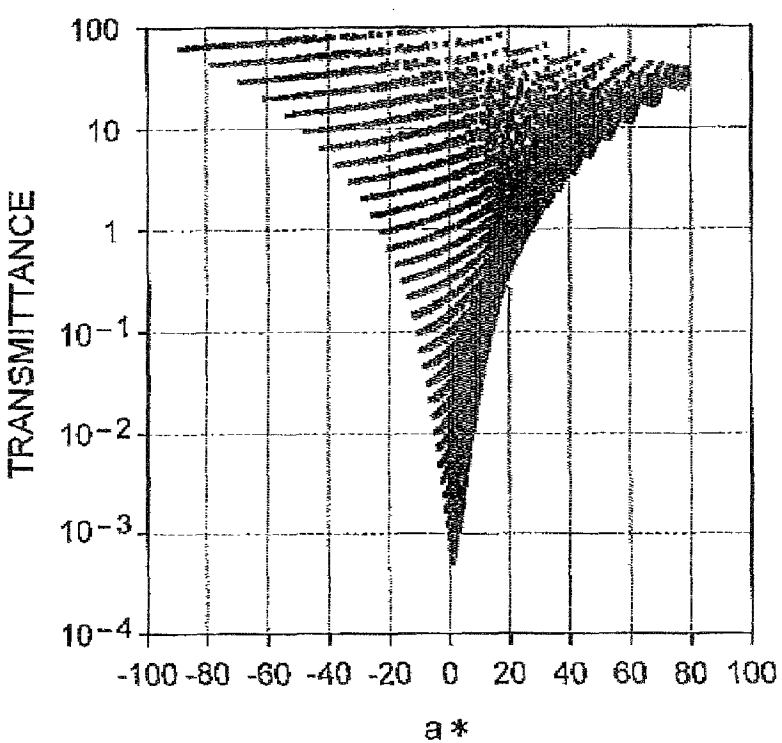

FIGS, 4A and 4B show the range of luminance and chromaticness (a*), which is represented in a HSV color coordinate system, i.e., a color space defined by CIE 1976, the range being obtained on LCD units. FIG. 4A shows the range represented by the LCD unit including two LCD devices, whereas FIG. 4B shows the range represented by a single LCD device. The ordinate represents the transmission factor (transmittance) normalized by the maximum transmittance which is expressed by 100, whereas the abscissa represents the degree of chromaticity, i.e., chromaticness.

Comparing FIG. 4A against FIG, 4B, it will be understood that a single LCD device also achieves a superior reproducibility of chromaticity in a higher luminance range and/or a higher chromaticness range. The higher luminance range is indicated by a larger digit in the ordinate, whereas the higher chromaticness range is indicated by a larger absolute value in the abscissa. Thus, it is sufficient that in a higher luminance (or chromaticness) range, only the first LCD device 113 be used for display of the original image data, with the second LCD device 114 being maintained at the maximum transmission state which does not display any image. On the other hand, in a lower luminance range, it is necessary that the second LCD device 114 be controlled to display a gray-scale level corresponding to the gray-scale level of the original image data and the first LCD device 113 displaying a color image be used for displaying the original image data in association with the second LCD device 114. This technique achieves a superior chromaticity reproducibility both in the higher luminance range (or higher chromaticness range) and a lower luminance range.

In the above example, the transmission factor of the second LCD device 114 is maintained at the maximum in the higher luminance or chromaticness range; however, it is unnecessary to maintain the second LCD device 114 strictly at the full transmission state or at the maximum transmission factor for all the pixels. For example, it is sufficient that the second LCD device 114 be maintained at a substantially full transmission state or substantially maximum bright state, such as at a 90% transmission factor. Hereinafter, the boundary between the first range in which only the first LCD device 113 is used to display an image and the second range in which both the first and second LCD devices 113, 114 are used to display the desired image is referred to as a threshold. Such a control of the first and second LCD devices provides a moderate discontinuity at least in one of the change of gray-scale level during driving the first LCD device 113 and the change of gray-scale level during driving the second LCD device 114.

Figure 5:
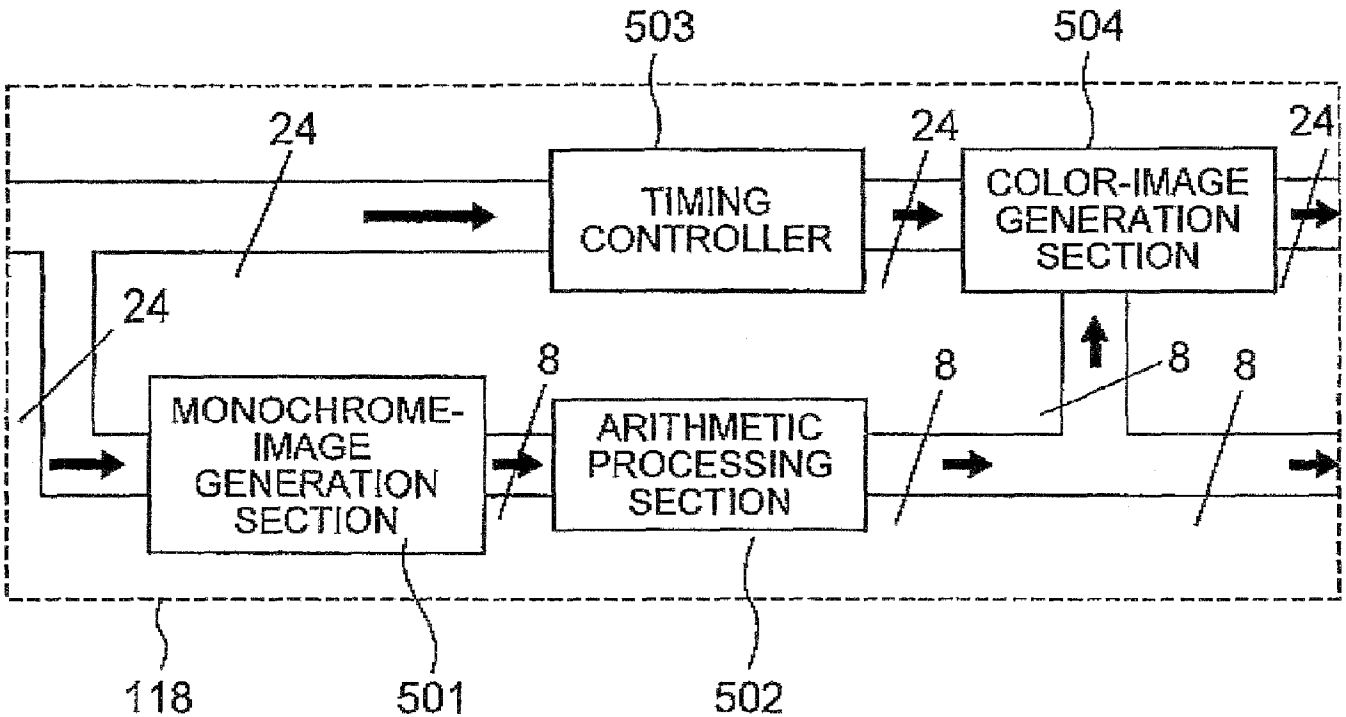
FIG. 5 is a functional block diagram of the signal processor provided in the LCD system of FIG. 1.

FIG. 5 shows the configuration of the signal processor 118 in a functional block diagram. The signal processor 118 includes monochrome-image generation section 501, arithmetic processing section (averaging processing section) 502, timing controller 503, and color-image generation section 504. The signal processor 118 receives, for example, the image data including a 8-bit signal per one primary color, and thus a total of 24 bits per each pixel, from the receiver 103 shown in FIG. 1. This image signal is delivered through two paths, one of which delivers the divided image signals to the monochrome-image generation section 501 and the other delivers the divided image signal to the timing controller 503. The monochrome-image generation section 501 generates a monochrome gray-scale-level signal (luminance signals) from the divided image signal, whereas the timing controller 503 reads out the divided image signal based on the timing signal of the output side in the sequential order of individual signals received based on the timing signal of the input side.

The monochrome-image generation section 501 generates, for example, a 8-bit monochrome image signal based on the luminance data of the input 24-bit color image signal. Generation of the monochrome image signal is performed by examining the gray-scale level of each of the primary colors, R, G and B of a pixel, and selecting one of the three primary colors having a maximum level among the three primary colors, and determining the gray-scale level of the selected primary color as the gray-scale level of the pixel. In an alternative, after performing a HSV conversion including brightness, chromaticity and hue conversion, brightness data is extracted therefrom and converted into the monochrome image data. In a further alternative, one of the R, G and B input image data is selected and converted into a monochrome signal. Two of the R, G and B input image data may be selected instead and subjected to signal conversion into a monochrome signal. It is to be noted that an area of a higher gray-scale level or higher transmission factor corresponds to an area of a higher luminance or higher chromaticness.

The monochrome-image generation section 501, after conversion into the monochrome image, changes the transmission factor of a pixel having a specific gray-scale level or above into a full-transmission state, and maintains the transmission factor of a pixel having a gray-scale level lower than the specific gray-scale level at the transmission factor of the original color image. In this processing, the gray-scale level of the monochrome-converted data is compared against a predetermined threshold, and if the gray-scale level is higher than the threshold, the transmission factor of the pixel is converted into the level of a full-transmission factor, for example. On the other hand, if the gray-scale level of the monochrome-converted signal is lower than the threshold, the gray-scale level is reassigned between the maximum value corresponding to the full-transmission state and the minimum value corresponding to the full-closed state.

The conversion processing of the gray-scale level is not limited to the processing as described above. For example, the monochrome image is subjected to a gamma curve conversion with the $\gamma$-value being set at about 4.0, and the area having a specific value of the gamma-converted transmission factor is turned to a full-transmission state. Alternatively, the transmission factor is subjected to a histogram adjustment or histogram conversion, and a transmission factor having a specific value therein may be turned to full-transmission state. In the monochrome-image generation section 501, it is sufficient that the area of a higher transmission factor be turned to a substantially full-transmission state, and thus other techniques may be employed for generating a monochrome image data or converting the transmission factor of the area having a higher transmission factor into the full-transmission state.

The arithmetic processing section 502 performs averaging processing to the monochrome image generated by the monochrome-image generation section 501. In the averaging processing, the technique described in Patent Application JP-2006-114523 may be used. In this technique, the image data of a plurality of pixels located within a distance of "r" (FIG.3) from a noticed pixel is subjected to an averaging processing or equalizing processing wherein the gray-scale level of the plurality of pixels are subjected to an weighted-averaging processing, The weighted-averaging processing is such that the gray-scale levels of the plurality of pixels are averaged while using the distance of the pixels from the noticed pixel is used as a weighting coefficient of the gray-scale levels to be averaged. The Gaussian distribution may be used as the weighted distribution. The averaging processing makes the edge or contour of the image obscure or ambiguous. The monochrome image subjected to the averaging processing is delivered to the second LCD device 114 from the arithmetic processing section 502 via the buffer memory 109 and transmitter 108 (FIG. 1).

The color-image generation section 504 generates color image based on the 24-bit image data including 8 bits for each of RGB colors and delivered via the timing controller 503 and the monochrome image data to which the averaging processing is performed in the arithmetic processing section 502. The color image data is delivered to the first LCD device 113 for display thereon. The timing controller 503 is disposed for the purpose of absorbing the time lag for generating the monochrome image. If the time lag is absorbed by effectively using the local memory 104 in FIG. 1, or if the timing adjustment itself is unnecessary, the timing controller 503 may be removed.

Since the observer of the LCD unit 116 observes the light passed by the first LCD device 113 and second LCD device 114, the luminance, i.e., total transmission factor of the image observed by the observe is a product of the transmission factors of both the LCD panels. The color-image generation section 504 corrects the color image to be displayed on the first LCD device 113 based on the image data of the second LCD device 114, to compensate the change or fall of the luminance in the second LCD device 114. This prevents the luminance to be observed by the observer from being changed from the luminance of the original image data.

The color-image generation section 504 performs processing of the 24-bit color image data based on the monochrome image data output from the arithmetic processing section 502, to generate a color image signal. More specifically, the color-image generation section 504 divides the image signal of the color image data by the luminance signal of the monochrome image, to generate the corrected color image signal for which the luminance is corrected, so long as the luminance is not at zero level. If the luminance of the monochrome image is at zero level, the luminance of the monochrome image is shifted by a specific value for avoiding division by zero. When the color-image processings section 504 generates the color image signal, the original image signal may be subjected to another image correction processing The color image generated by the color-image generation section 504 is delivered to the first LCD device 113 via the buffer memory 106 and transmitter 107.

In the LCD unit 116, as described above, the first LCD device 113 is driven by the color image data generated in the color-image generation section 504, whereas the second LCD device 114 is driven by the monochrome image data subjected to the averaging processing in the arithmetic processing section 502. If the observer observes only the display on the second LCD device 114, the area having a higher luminance is in a full-transmission state and the other area has an obscure image due to the averaging processing. On the other hand, if the observer observes only the first LCD device 11, the image observed in the area in which the second LCD device 114 is not in the full-transmission state is an emphasized image. The "emphasized image" as recited herein is such that the luminance and chromaticness in the image are emphasized, and obtained by correcting the luminance of the first LCD device 113 based on the luminance on the second LCD device 114.

Setting of the threshold used for conversion by the monochrome-image generation section 501 is analyzed hereinafter. If the change rate of the luminance with respect to the original image for the second LCD device 114 exceeds 20% after the averaging processing in the arithmetic processing section 502, the changed amount of the chromaticness and hue will be large even if the color-image generation section 504 adjusts the luminance signal for the first LCD device 113, thereby causing a sense of discomfort. For prevention of such a case, the threshold of the conversion into the monochrome image is preferably set within a range between 20% and 80% of the input image data to thereby display the image without the sense of discomfort, even if a fluctuation of around 20% occurs in the input image data. In addition, since the area of a higher luminance or chromaticness can be displayed only by the first LCD device 113, as described above with reference to FIG. 4, the above upper limit (80%) of the threshold may be preferably lowered to 60%, to thereby increase the area of the full-transmission in the second LCD device 114. This provides a desirable situation wherein the area which can be displayed only by a singe LCD device is displayed only by the first LCD device 113 as much as possible. Further, a threshold set in the range between 30% and 50% will allow the first LCD device 113 to display the image as much effectively as possible, thereby providing the image of a less sense of discomfort.

In order to verify the advantages of the present embodiment, an image signal subjected to the above image processing was input to the first LCD device 113 and second LCD device 114 in the image display system 100 for display of an image. In this case, suitable luminance and chromaticness of the image comparable to those in the case of display only on the first LCD device 113 were obtained In addition, as to the contrast ratio, a contrast ratio as high as 500,000:1 was obtained. Observation in a slanted viewing direction provided a superior display quality with a less influence by a parallax due to performing the averaging processing. Although the LCD unit used in this experiment had a contrast ratio of 700:1, the present embodiment will provide a further higher contrast ratio if the LCD unit includes LCD devices having a higher stand-alone contrast ratio or three or more LCD devices having a similar stand-alone contrast ratio.

Although the image source unit 117, image-data processing unit 105, and LCD unit 116 are shown as separated from one another in FIG. 1, these units may be configured by single hardware or may be received in a single housing. In one example, the image source unit 117 and image-data processing unit 105 is received in a single housing, and the LCD unit is received in a separate housing. The image processing in the image-data processing unit 105 may be performed using a hardware image processing device or may be performed using software running on a CPU.

The averaging processing may be performed outside the image-data processing unit 105, and may be performed in the image source unit 117 using software running on a CPU or using a graphic chip such as represented by a MPEG recorder. In this case, two sets of signal cable 120 (shown in FIG. 1) may be provided between the image source unit 117 and the image-data processing unit 105, whereby the image displayed on the first LCD device 113 is output separately from the image displayed on the second LCD device 114.

Although monochrome-image generation section 501 and color-image generation section 504 in the signal processor 118 generate the image signal by performing the signal processing in the above embodiment, the present invention is not limited thereto. For example, a lookup table tabulating input signals and corresponding output signals may be used in the monochrome-image generation section 501 The lookup table may be a three-dimensional table which provides a monochrome gray-scale level based on each gray-scale level of RGB input image signals. The color-image generation section 504 may generate the color image by using a 4-dimensional lookup table, which provides a gray-scale level of the color image based on the each gray-scale level of the input image data and the gray-scale level of the monochrome image data.

In the exemplary embodiments the first LCD device 113 includes the color filter layer 251; however, the color filter layer is not an indispensable element as to elimination of the sense of parallax by displaying the averaged image data. More specifically, both the first and second LCD devices 113 and 114 may be a monochrome LCD device to obtain a monochrome LCD unit.

In the above exemplary embodiment, a single pixel includes three sub-pixels corresponding to three primary colors in the color filter layer; however, the color filter layer may include other combination of multiple colors such as RGBYMC. In such a case, the single pixel includes sub-pixels in number corresponding to the colors of the color filter layer. In an alternative, the single pixel may include four sub-pixel areas corresponding to RGGB colors or corresponding to RGB colors and an area without a color, i.e., RGBW.

The present invention may be applied to other than the IPS-mode LCD device. The LCD device of the present invention may be of any of a variety of modes including vertical-alignment mode (VA-mode), twisted-nematic mode (TN-mode), optically-bend compensated mode (OBC-mode) FIG. 2 shows the structure of the LCD unit including no retardation compensation layer; however, the LCD unit may include a retardation compensation layer between the LCD panel 261, 262 and the polarizing films for improving the viewing angle characteristic. The optical characteristic of the retardation compensation layer may be selected depending on the mode of the LC layer 231, 232.

For example, if a retardation compensation layer is to be provided between the polarizing film 201, 202 and the first LCD device 113 which is driven by the IPS-mode, the retardation compensation layer preferably has a characteristic of nx≧ny>nz, wherein nx, ny and nz are the refractive index of the retardation compensation layer parallel to the substrate surface, refractive index in the direction normal to the direction of nx and parallel to the substrate surface, and refractive index in the direction normal to the direction of nx and ny, respectively, with the direction of nx being parallel to the optical absorption axis or optical transmission axis of the polarizing film 210, 202. The retardation compensation layer having such a characteristic improves the viewing angle characteristic of the first LCD device 113. The retardation compensation layer may have a plurality of films having such an overall characteristic in combination.

As to the first LCD device 113 driven by the VA-mode, a retardation compensation layer having the characteristic of nx ≧ny>nz may be provided with the direction of nx being parallel to the optical absorption axis or optical transmission axis of the polarizing film 201, 202, to improve the viewing angle characteristic of the first LCD device 113. If the first LCD device 113 is driven by the TN-mode or OCR-mode, the retardation compensation layer may be a WV film configured by a discotheque LC layer having a negative retardation, wherein the axial direction of the discotheque LC layer is continuously changed in the thickness direction thereof, for improving the viewing angle characteristic.

The retardation compensation layer may be provided on one side of the LCD panels 261, 262, or may be provided on both sides thereof. The retardation compensation layer may be provided in any gap between the LC layer 231, 232 and an adjacent one of the polarizing films 201-204. A plurality of retardation compensation layers may be provided instead of a single retardation compensation layer. It is to be noted that the full transmission of the pixels in the second LCD device 114 having a gray-scale level which is above the threshold may have some range of variation so long as it is roughly constant, i.e., may be a few percents higher or lower than the fixed value.

Figure 6:
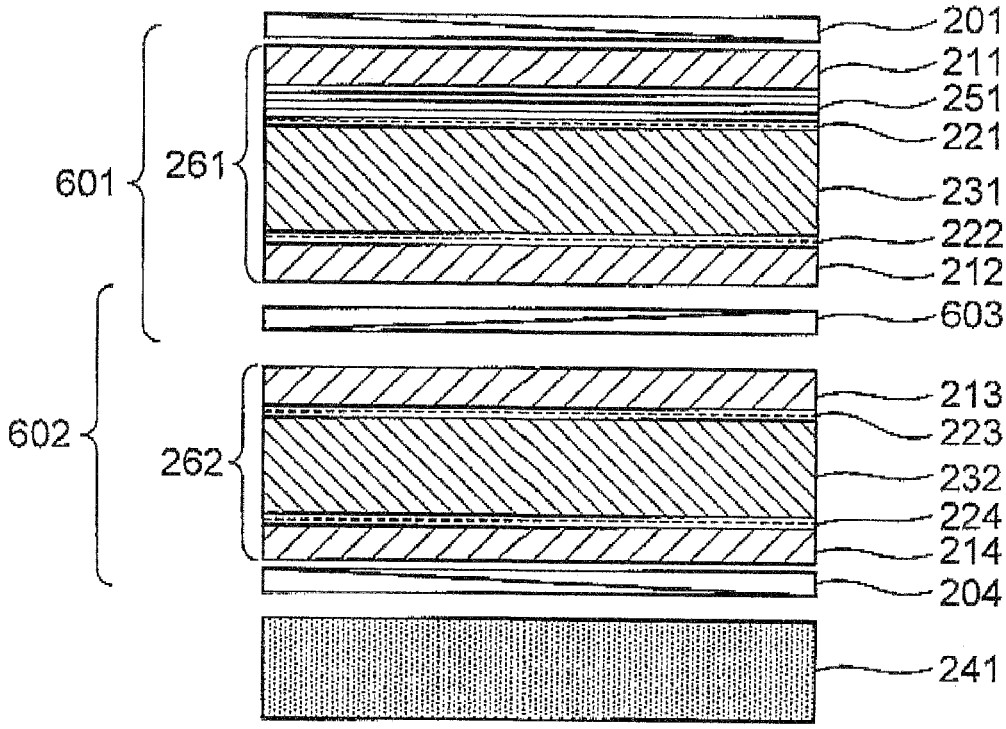
FIG. 6 is a sectional view of a LCD unit in a LCD system according to a second exemplary embodiment of the present invention.

FIG. 6 shows the sectional structure of a LCD unit in a LCD system according to a second exemplary embodiment of the present invention. In the first embodiment, as shown in FIG. 2, two polarizing films are provided between the first LCD panel 261 and the second LCD panel 262, wherein the polarizing film 202 is provided in the first LCD device 113 and the polarizing film 203 is provided in the second LCD device 114. In the LCD unit of the present embodiment, one of the two polarizing films is omitted with the other of the polarizing films being shared by the first LCD panel 601 and second LCD panel 602. Other configurations are similar to those of the first embodiment.

In the first embodiment, two polarizing films 202 and 203 interposed between the LCD panel 261 and the LCD panel 262 are arranged so that the optical transmission axes or optical absorption axes thereof are parallel to one another, to minimize the optical absorption in the LCD unit. However, the provision of two polarizing films reduces the optical transmission factor by about 20%. In this view, the present embodiment uses the lo single polarizing film 603 between both the LCD panels 601 and 602. If the LCD panels are provided in number of n, where n is an integer not less than two, the present embodiment improves the luminance by about $1/(0.8^{n-1})$ over the first embodiment.

A LCD system according to a third exemplary embodiment of the present invention will be described hereinafter. Each of the above embodiments uses a white light source such as CCFL and LED. In the present embodiment, the LCD system includes a trichromatic light source which emits RGB lights in a time division mode. The LCD devices stacked one on another display images corresponding to RGB colors in a field-sequential scheme in a time division mode. The method for generating the image data for driving the first and second LCD panels is similar to that in the first embodiment. The present embodiment achieves advantages similar to those in the first and second embodiments.

A LCD system according to a fourth embodiment of the present invention will be described hereinafter. The fourth embodiment uses a driving scheme wherein the angle of the LC molecules with respect to the substrate surface is changed by an applied voltage, such as in a TN-mode. In this driving scheme, the conventional technique incurs the problem of a degraded viewing angle characteristic occurring depending on the viewing angle of the observer. The degraded viewing, angle characteristic results from the birefringence characteristic of the LC layer, wherein the LC molecules appear to have a different shape depending on the viewing angle of the observer. The LCD unit including a plurality of LCD devices having such a degraded viewing angle characteristic will have a synergetic effect of degradation depending on the number of LCD devices stacked. In this embodiment, each adjacent two of the LCD devices have opposite viewing angle characteristics to cancel the viewing angle dependency of each other. This improves the viewing angle characteristic of the LCD system of the present embodiment.

A LCD system according to a fifth embodiment of the present invention will be described hereinafter. The LCD system of the present embodiment is such that the second LCQD device 114 for display of a monochrome image is omitted from the LCD unit of the first embodiment shown in FIG. 1. In addition, the LCD system includes a light source for which the dot intensity is controlled. More specifically, the light source includes a plurality of LEDs arranged in a matrix, wherein each of the LEDs is controlled for the emission intensity thereof. In an exemplary case, the light source includes 480×640 LEDs each configured by a white-color high-luminance LED and corresponding to each pixel of the second LCD device 114, and a light diffusion sheet is disposed in front of the light source.

The monochrome image data averaged by the arithmetic lo processing section 502 (FIG. 5), which is used for driving the second LCD device 114 in FIG. 1, drives the light source in a dot-matrix driving scheme instead of the second LCD device 114. That is, the emitting pattern of the backlight source in the present embodiment corresponds to the image achieved by a combination of the light source 115 and the second LCD device 114 in the first embodiment. In this configuration, the light source driven by the dot-matrix scheme has the function of both the light source 115 and second LCD device 114 shown in FIG. 1, whereby the LCD device in the present embodiment corresponding to the LCD device 113 in FIG. 1 receives light similar to that received by the first LCD device 113 in FIG. 1. Thus, the LCD unit of the present embodiment has an apparent higher contrast ratio by using a single LCD device.

In the fifth embodiment, the combination of a single LCD panel and a light source driven by a dot-matrix driving scheme has a function similar to that of a LCD unit including two LCD devices. Alternatively, a monochrome-image driving circuit and an additional LCD device may be provided thereto Drive of the monochrome LCD panel and the light source including a matrix of dot light sources by using the monochrome image data described in the first embodiment provides a high contrast ratio in addition to maintaining the chromaticness and hue comparable to those of the original image.

In the above embodiments, TFTs are used as driving elements for driving the LCD panel. The TFTs may be replaced by thin-film diodes (TFDs). In addition, if the LCD device has a relatively lower resolution, the LCD device may be driven in a passive-matrix driving scheme.

The LCD unit of the above embodiments achieves a higher contrast ratio, and thus may be preferably used as a diagnostic imaging device for which a high-contrast-ratio image display is desired, a monitor TV for use in a broadcasting station, or a LCD unit for providing a picture image in a dark area such as a film theater.

In FIG. 1, the image-data processing section 105 generates the image data for both the first and second LCD devices 113, 114. However, the image processing section 105 may be divided into a plurality processing sections corresponding to the LCD devices provided in the LCD unit 116.

Figure 7:
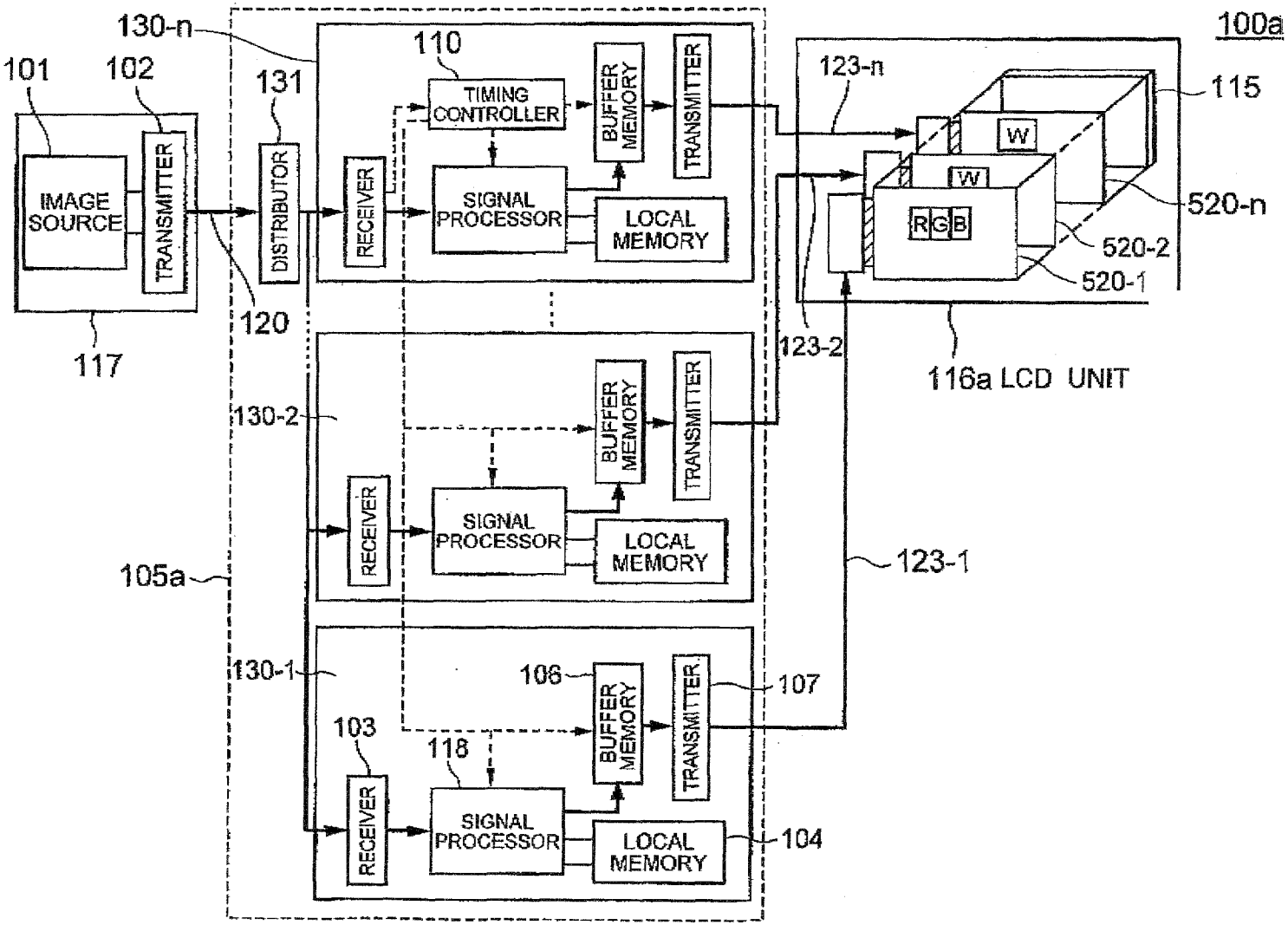
FIG. 7 is a block diagram of a LCD unit modified from the LCD unit of the first exemplary embodiment.

FIG. 7 shows a modification of the first embodiment, wherein the LCD system 100*a* includes a plurality of processing sections 103-1 to 130-n provided in an image-data processing unit 105*a*, corresponding to the plurality of LCD devices 520-1 to 520-n provided in the LCD unit 116*a*.

The image data supplied from the image source unit 117 is distributed to each image-processing unit 130 by a distribution unit 131. Each image-processing unit 130 generates image data to be displayed on a corresponding LCD panel 520. The thus generated image data is input to the LCD unit 116*a* via signal cables 123-1 to 123-n. The timing controller 110 is provided in one of the processing sections 130-1 to 130-n to control the timing by which the processing sections 130-1 to 13-n are controlled, allowing the images on the LCD panels 420 to be synchronized with one another.

In FIG. 7, the LCD panel 520-1 is a color LCD panel, whereas other LCD panels 520-2 to 520-n are monochrome LCD panels, The arithmetic processing units in the image-data processing sections 130-2 to 130-n include a monochrome-image generation section 501 and an averaging processing section 502 (FIG. 5), and output the averaged monochrome images to the LCD panels 520-2 to 520-n via the signal cables 123-2 to 123-n. The image-processing unit 130-1 includes a color-image generation section 504, and outputs the image data to the first LCD panel 520-1 via the signal cable 123-1. The LCD system 100*a* of the present modification achieves advantages similar to those in the first embodiment.

In FIG. 5, color-image generation section 504 generates a 24-bit color image signal from the 8-bit image data for each of RGB colors, However, the number of bits of the input data and output data is not limited to this example. For example, assuming that the number of gray-scale levels for each LCD device is m, the maximum number of gray-scale levels which can be displayed on the LCD unit including n LCD panels is n×m. Thus, by using the input image data having gray-scale levels in number of m to $m^2$, the color-image generation section 504 may generate color image data having m gray-scale levels.

In the fifth embodiment, the exemplified light source includes LEDs arranged in a matrix and driven by a dot-matrix driving scheme. The present invention is not limited to this example. The light source may include electric bulbs, organic electro-luminescence (EL) devices, inorganic EL devices, FEDs, and PDPs, which can be driven by a dot-matrix driving scheme. The LCD panels stacked one on another need not be driven by a common image source, and may be driven by separate driving data including image display and emphasizing data, for example for each of the LCD panels.

The LCD system of the present invention can be used in an electronic equipment, image data adjustment device, image switching device, diagnostic imaging device. The present embodiment can be applied to a building wherein the LCD unit of the present invention and an acoustic device or devices are installed and fixed.

A sixth embodiment of the present invention will be described hereinafter. The arithmetic processing section 502 of the first embodiment shown in FIG. 5 performs averaging processing by using the Gaussian distribution. The arithmetic processing section in the present embodiment uses a different weighted averaging technique, which provided a superior result in an experiment.

Figure 8A:
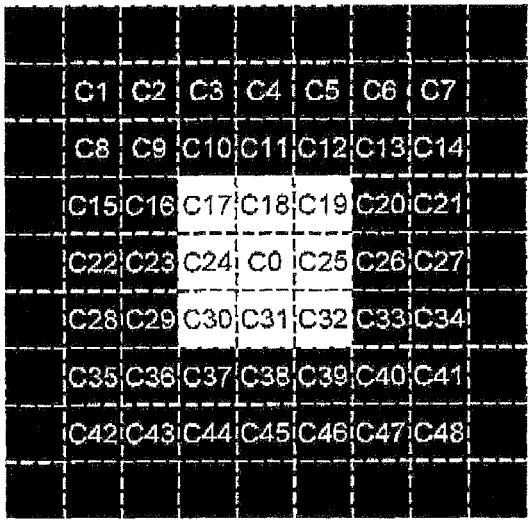
FIGS. 8A and 8B show bright area and range of averaging processing are, respectively, on a screen.

It is assumed here for the present embodiment that there is a bright area in a dark background on the screen, the bright area having a luminance of 100 and including a central pixel, and that the bright area is defined by ±P pixels disposed adjacent to the central pixel in an i-direction (for example, row direction) and ±Q pixels disposed adjacent to the central pixel in a j-direction (for example, column direction). FIG. 8A shows an example of the above assumed case wherein the central pixel of the bright area is represented by C0, and the numbers P and Q defining the bright area are set at P=1 and Q=1, for a simplification purpose.

Figure 8B:
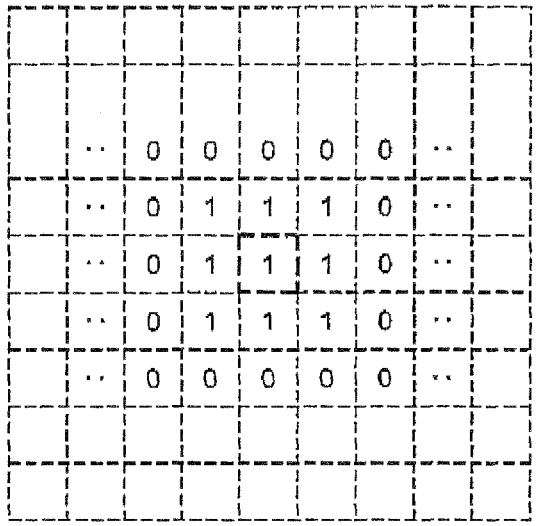

FIG. 8B shows the range of weighted-averaging processing including a subject pixel and adjacent pixels which are located ±M pixels and ±N pixels apart from the subject pixel in i-direction and j-direction, respectively. In this example, M and N are set at M=1 and N=1, and the weighting coefficient is "1" for the subject pixel and adjacent 8 pixels adjacent to the subject pixel.

In the above case, if pixel C9 near the corner of the bright area is selected as the subject pixel, the weight-averaged luminance $Y_{C9}$ of pixel C9 is expressed by the following formula:

$$Y_{C9}=(Y_{C1}\times1+Y_{C2}\times1+Y_{C3}\times1+Y_{C8}\times1+Y_{C9}\times1+Y_{C10}\times1+Y_{C15}\times1+Y_{C16}\times1+Y_{C17}\times1)\div9$$

Here, since $Y_{C1}=Y_{C2}=Y_{C3}=Y_{C8}=Y_{C9}=Y_{C10}=Y_{C15}=Y_{C16}=0$ and $Y_{C17}=100$, the above formula yields:

$$Y_{C9}=11.1$$

Similarly, $Y_{C13}$ of pixel C13, $Y_{C35}$ of pixel C35 and $Y_{C40}$ of pixel C40 are calculated to have a weight-averaged luminance of 11.1. Other weight-averaged luminance $Y_{CN}$ is similarly obtained, wherein $Y_{C10}$, $Y_{C12}$, $Y_{C16}$, $Y_{C20}$, $Y_{C29}$, $Y_{C33}$, $Y_{C37}$ and $Y_{C39}$ are 22.2, $Y_{C11}$ and $Y_{C32}$ are 44.4, $Y_{C18}$, $Y_{C24}$, $Y_{C25}$ and $Y_{C21}$ are 66.6, and $Y_{C0}$ is 100. This weight-averaged luminance distribution appearing on a screen is shown in FIG. 9.

In this example, nine pixels including the subject pixel and adjacent pixels have the same weighting factor (=1). In this case, if the averaging processing uses a larger number of adjacent pixels adjacent to the subject pixel, a stronger averaging effect can be obtained. However, if a larger number of adjacent pixels are employed for the averaging processing in the case where the adjacent pixels are applied with an arbitrary weight-coefficient distribution, the luminance is lowered compared to the example shown in FIG. 9.

In the above case, if the number of pixels adjacent to the subject pixel in the averaging processing is smaller than the case of FIG. 8B, i.e., if numbers M and N of the range of averaging processing are smaller, the luminance obtained by the averaging processing is lowered. In short, the number of pixels in the bright area and/or the range of pixels in the averaging processing will provide a different averaging effect.

Figure 9:
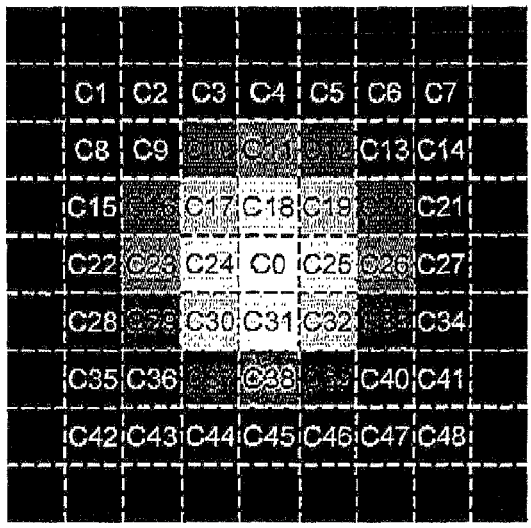
FIG. 9 is an example of an image on a screen obtained by weighted-averaging processing.

In the example of FIGS. 8A, 8B and 9, the weighing coefficient is fixed at "1" for the subject pixel and adjacent pixels in the averaging processing. A different case wherein the weighting coefficient follows the Gaussian distribution will be described hereinafter with reference to FIGS. 10A to 10C which show different cases of luminance on the screen.

Figure 10A:
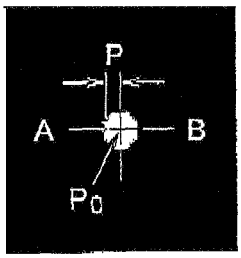
Figure 10B:
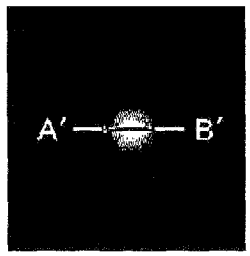

FIG. 10A shows an example of the original bright area having a luminance of 100 before the averaging processing, the bright area having a width of P at one side from the pixel located at original point Po. FIG. 10B shows the luminance on the screen after the weighted-averaging processing of the luminance of FIG. 10A by using the weighting coefficient following the Gaussian distribution, and FIG. 10C shows a luminance modified from FIG. 10A by applying a change of luminance thereto without lowering the original luminance.

Figure 10C:
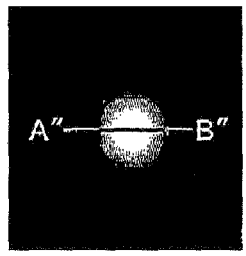

The luminance shown in FIG. 10B is lowered from the original luminance of FIG. 10A, and also is lower than the luminance shown in FIG. 10C. This reveals that the weighting coefficient following the Gaussian distribution may degrade the original luminance, which is undesirable, after the averaging processing.

Figure 11:
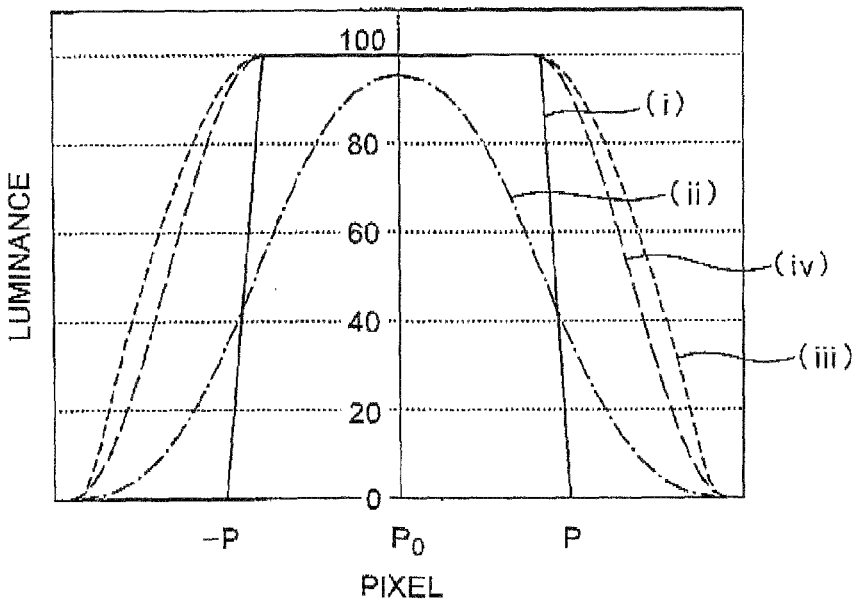
FIG. 11 shows a graph of an original luminance distribution and luminance distributions by averaging processing of the original luminance.
Figure 12:
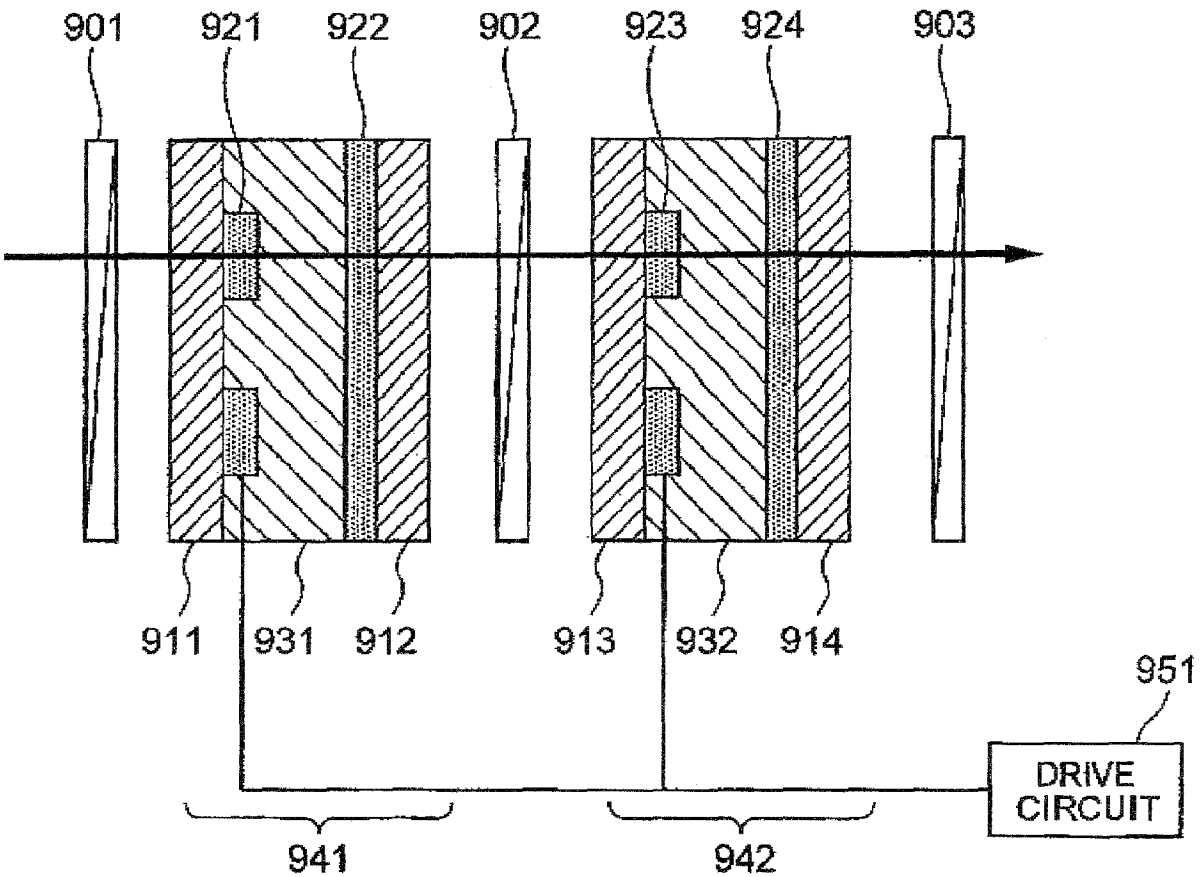
FIG.12 PRIOR ART
FIG. 12 is a schematic sectional view of a conventional LCD unit including two LCD panels.

FIG. 11 shows the luminance distribution along the line A-B, A'-B' and A"-B" shown in FIGS. 10A, 10B and 10C, respectively. The ordinate represents the normalized gray-sale level, and the abscissa represents the distance of pixels with respect to the pixel of the original point Po. The graph (i) showing the luminance distribution of FIG. 10A has a luminance of 100 at the original point P0 and up to the pixels of ±P apart from the Po, and a luminance of zero outside the pixels of ±P. The graph (ii) showing the luminance distribution of FIG. 10B, which is obtained by averaging processing using the weighting coefficient following the Gaussian distribution, has a luminance less than 100 near the boundary between 100 and 0 of graph (i), and thus has a lower luminance compared to the graph (i). This is because, in the case of FIG. 10B, a smaller bright area and/or larger range of pixels used for averaging processing provide a lower luminance compared to the original luminance before the averaging processing.

If the range of averaging processing is zero, i.e., only the central pixel is used for the averaging processing, the luminance does not change after the averaging processing. In general, if the averaging processing uses a larger range of adjacent pixels adjacent to the subject pixel, a higher averaging effect is obtained. However, the central pixel having a luminance of 100 reduces the original luminance thereof after the averaging processing. In short, the averaging processing using a weight coefficient following a weight coefficient distribution inevitably causes the pixel having a higher luminance to lose the original luminance. Thus, the averaging processing for restricting the parallax between a plurality of LCD panels stacked one on another may incur reduction in the luminance of the pixels in a narrow bright area, although the averaging processing alleviates the object parallax itself.

In the view point as described above, a different averaging processing is used in the present embodiment to obtain the luminance distribution of FIG. 10C. The luminance shown in FIG. 10C provides an averaged luminance distribution expressed by the graph (iii) shown in FIG. 11, which maintains the luminance 100 of graph (i) in the range of ±P, and has a luminance change outside the range of ±P in the vicinity of the boundary between the luminance of 100 and luminance of zero. Graph (iv) shown in FIG. 11 shows another example of the averaged luminance distribution, which is similar to the averaged luminance distribution of graph (iii). These luminance distributions of graphs (iii) and (iv) are such that a luminance change is provided in the original luminance distribution without reducing the original luminance.

In the first embodiment, the result of the averaging processing using a weighting coefficient following the Gaussian distribution is output as it is for the first LCD panel. In the present embodiment, histogram clipping processing and histogram enlargement processing are performed to a luminance (gray-scale level) histogram of the pixels. More specifically, a clipping treatment is performed at the threshold for the gray-scale level histogram of the pixels obtained by the averaging processing, to remove a higher luminance portion of the gray-scale histogram above the threshold, and the entire clipped histogram is then enlarged or extended as a whole in the direction of the gray-scale level up to the gray-scale level of the full transmission, whereby the gray-scale histogram between the minimum gray-scale level and the threshold is extended or enlarged to have a range between the minimum gray-scale level and the gray-scale level of full transmission. The clipping and enlargement of the histogram may be performed for the gray-scale level or the luminance itself. In addition, before or after the clipping treatment, the gamma characteristic defining the linearity of the gray-scale level-luminance characteristic may be converted to further reduce the parallax.

It is assumed here that the subject pixel located at a coordinate (i,j) has a gray-scale level of f(i,j) and the gray-scale level obtained from the result of the averaging processing to the luminance of the subject pixel is g(i,j), and that the range of the averaging processing is ±M pixels in the i-direction, and ±N pixels in the j-direction. In such a case, the weight-averaged gray-scale level g(i,j) is represented by:

$$g(i,\ j) = S_{MAX}\left\{\sum_{k=-M}^{M}\sum_{l=-N}^{N} f(i+k,\ j+l)G(i,\ j)/S_{MAX}\right\}^{1/\gamma},$$

where G(i,j), γ and $S_{MAX}$ represent an arbitrary weighting factor distribution matrix, gamma value and maximum gray-scale level, respectively. It is to be noted that i-th direction and j-th direction are not necessarily perpendicular to one another. More specifically, a delta array may be used therein. In this case, the weighting coefficient G(i,j) follows the Gaussian distribution; however, G(i,j) may be a matrix following another distribution.

Another averaging processing may be employed using clipping and enlargement of histogram obtained by a simple averaging processing, without using a weighting coefficient distribution. This type of processing may be expressed by:

$$g(i, j) = S_{MAX}\left\{\frac{1}{(2M+1)(2N+1)}\sum_{k=-m}^{M}\sum_{l=-N}^{N} f(i+k, j+l)/S_{MAX}\right\}^{1/\gamma}.$$

In a further alternative, a simple averaging of the averaged luminance of the subject pixel obtained by the weighted-averaging processing using ±M pixels in i-direction and ±N pixels in j-direction and the original luminance of the subject pixel may be employed and then subjected to the histogram clipping and enlargement. This processing may be expressed by the following formula:

$$g(i, j) = S_{MAX}\left[\left\{f(i+k, j+l) + \sum_{k=-M}^{M}\sum_{l=-N}^{N} f(i+k, j+l)G(i, j)\right\}\Big/(2S_{MAX})\right]^{1/\gamma}$$

By using these processings, the image of the pixels can be converted into the averaged luminance without reducing the original luminance of the pixels.

The matrix G(i,j) is other than the following matrix:

$$\frac{1}{m}\begin{bmatrix} 0 & 0 & \cdots & 0 & 0 \\ 0 & \cdots & & \cdots & 0 \\ & & n & & \\ 0 & \cdots & & \cdots & 0 \\ 0 & 0 & \cdots & 0 & 0 \end{bmatrix}$$

where m=1, 2, . . . , and n=1, 2, . . . , because this matrix only changes the luminance without performing the weighted-averaging.

The signal processor 118 of the image-data processing unit 105 described in the first through sixth embodiments is typically configured by a FPGA for implementing the algorithm of the image processing. However, the signal processor 118 shown in FIG. 5 may be configured by a plurality of separate sections 501 to 504. The image processor 118 may be configured by a single chip including therein timing controller 110 and local memory 104, or many be configured by a single chip including therein buffer memories 106, 109 and transmitters 107, 108 for delivering two sets of image data.

Alternatively, the image-data processing unit 105 may be configured by a single chip or a multi-chip module. The image-data processing unit 105 receives the image data signal from the image source unit 117 to perform the signal processing, which may include a lookup table and generate a plurality of image data sets. The plurality of image data sets drive a plurality of LCD devices stacked one on another in the LCD unit 116. This achieves a higher contrast ratio, which a single LCD device cannot achieve.

In addition, although the signal transmission between the image source unit 117 and image-data processing unit 105 in FIG. 1 is implemented by a combination of a single transmitter 102 and a single receiver 103. However, the LCD system may employ a plurality of transmitters and a plurality of transmitters for such a signal transmission depending on a design choice.

As described heretofore, the present invention may have the following configurations.

In a first aspect, the present invention is directed to a liquid crystal display (LCD) system including: a LCD unit displaying a color image and including a plurality (n) of LCD panels stacked one on another; and an image-data processing unit for generating image data based on input data to drive the LCD unit, the plurality of LCD panels including: a first LCD panel including a color filter layer; and a second LCD panel including no color filter layer, the image-data processing unit including: a monochrome-image generation section for generating monochrome image data based on the input image data to output the monochrome image data to the second LCD panel, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the input image data and the monochrome image data to output the color image data to the first LCD panel.

In one embodiment of the first aspect, the color image data may specify for the first pixel a second gray-scale level corresponding to an original gray-scale level of the first pixel specified in the input image data, and specify for the second pixel a third gray-scale level which is corrected from the original gray-scale level of the second pixel specified in the input image data by an amount corresponding to a difference in a transmission factor between the full transmission and a transmission of the first gray-scale level.

In another embodiment, the color image data may specify that a color of each pixel observed by an observer observing light passing through the first and second LCD panels be an original color of the each pixel specified in the input image data.

In another embodiment, the monochrome-image generation section may convert the input image data into first monochrome image data, and perform histogram clipping and enlargement of the first monochrome image data to calculate the first gray-scale level.

In another embodiment, the monochrome-image generation section, upon generation of the first monochrome image data, may select a primary color having a maximum gray-scale level in the input image data among all primary colors, and determine gray-scale levels of the selected primary color as gray-scale levels in the first monochrome image data.

In another embodiment, the monochrome-image generation section, upon generation of the first monochrome image data, may convert the input image data into a HSV color coordinate system to extract a luminance component, and determines a gray-scale level of each pixel based on the extracted luminance component.

In another embodiment, the monochrome-image generation section, upon generation of the first monochrome image data, may select one of primary colors in the input image data, and determine a gray-scale level of each pixel based on a gray-scale level of the selected one of the primary colors.

In another embodiments the monochrome-image generation section, upon generation of the first monochrome image data, may select two of primary colors in the input image data, and determine a gray-scale level of each pixel by performing processing of gray-scales of the selected two of primary colors.

In another embodiment, the threshold may be within a range between 20% and 80% of a transmission factor of the full transmission.

In another embodiment, the threshold may be within a range between 20% and 60% of a transmission factor of the full transmission.

In another embodiment, the threshold may be within a range between 30% and 50% of a transmission factor of the ful transmission.

In another embodiment, each of the plurality of LCD panels other than the first LCD panel may include no color filter layer.

In another embodiment, the first and second LCD panels may have a common pixel resolution.

In another embodiment, the first LCD panel may include a pixel including three sub-pixels, and the color filter layer may include RGB color filters.

In another embodiment, the first LCD panel may include a pixel including four to seven sub-pixels, and the color filter layer may include RGB color filters and at least one of yellow, magenta, cyan and transparent filters.

In another embodiment, the image-data processing unit may further include an arithmetic processing section for performing averaging processing of the monochrome image data generated by the monochrome-image generation section, to output resultant averaged image data to the second LCD panel and the color-image generation section.

In another embodiment, the arithmetic processing section may perform the averaging processing by weighted-averaging of gray-scale levels of adjacent pixels located within a specified distance apart from a subject pixel while using a weighting coefficient which depends on the distance between the adjacent pixels and the subject pixel.

In another embodiment, the weighting coefficient may follow the Gaussian distribution.

In another embodiment, the arithmetic processing section may provide a change of luminance to the monochrome image data without reducing original luminance of the monochrome image data.

In another embodiment, the arithmetic processing section may perform a weighted-averaging processing using a weighting coefficient distribution in a range of ±M pixels and ±N pixels located within a specified distance apart from a subject pixel in an i-th direction and j-th direction, respectively, and perform clipping and enlargement of a histogram of resultant averaged gray-scale levels to thereby provide the change of luminance without reducing original luminance of the monochrome image data.

In another embodiment, the arithmetic processing section may perform weighted-averaging processing of a subject pixel (i,j) having a gray-scale level f(i,j) to generate a weight-averaged gray-scale level g(i,j) by using the following formula:

$$g(i,\ j) = S_{MAX}\left\{\sum_{k=-M}^{M}\sum_{l=-N}^{N} f(i+k,\ j+l)G(i,\ j)/S_{MAX}\right\}^{1/\gamma},$$

where G(i,j), γ and $S_{MAX}$ represent arbitrary weighting factor distribution matrix, gamma value and maximum gray-scale level, respectively.

In another embodiment, the arithmetic processing section may perform weighted-averaging processing using a weighting factor in a range of ±M pixels and ±N pixels apart from the subject pixel in the i-direction and j-direction, respectively, and perform clipping and enlargement of a histogram of resultant averaged gray-scale levels, to thereby change a luminance of pixels without reducing the luminance thereof.

In another embodiment, the arithmetic processing section performs averaging processing of a subject pixel (i,j) having a gray-scale level f(i,j) to generate a weight-averaged gray-scale level g(i,j) by using the following formula:

$$g(i,\ j) = S_{MAX}\left\{\frac{1}{(2M+1)(2N+1)}\sum_{k=-m}^{M}\sum_{l=-N}^{N} f(i+k,\ j+1)/S_{MAX}\right\}^{1/\gamma},$$

where G(i,j), γ and $S_{MAX}$ represent arbitrary weighting factor distribution matrix, gamma value and maximum gray-scale level, respectively.

In another embodiment, the arithmetic processing section may perform: the averaging processing using a weighting factor in a range of ±M pixels and ±N pixels apart from the subject pixel in the i-direction and j-direction, respectively, to generate weighted-averaged luminance; simple averaging processing of the weight-averaged luminance and luminance of the subject pixel; and clipping and enlargement of a histogram obtained of resultant averaged luminance, to thereby change a luminance of pixels without reducing the luminance thereof.

In another embodiment, the arithmetic processing section may perform averaging processing of a subject pixel (i,j) having a gray-scale level f(i,j) to generate a weight-averaged gray-scale level g(i,j) by using the following formula:

$$g(i,\ j) = S_{MAX}\left[\left\{f(i;k,\ j+l) + \sum_{k=-M}^{M}\sum_{l=-N}^{N} f(i+k,\ j+l)G(i,\ j)\right\}\Big/(2S_{MAX})\right]^{1/\gamma}$$

where G(i,j), γ and $S_{MAX}$ represent arbitrary weighting factor distribution matrix, gamma value and maximum gray-scale level, respectively.

In another embodiment, the LCD panels each may have a number (m) of gray-scale levels, and the LCD unit has a number of a grayscale levels which is not less than m and not larger than $m^n$.

In another embodiment, the LCD panels may be driven by a drive mode such that LC molecules aligned in a direction parallel to the LCD panels are driven between a light transmission state and a light interception state by an electric field substantially parallel to the LCD panels.

In another embodiment, the LCD panels may be driven by a drive mode such that LC molecules aligned in a direction perpendicular to the LCD panels are driven between a light transmission state and a light interception state by an electric field substantially perpendicular to the LCD panels.

In another embodiment, the LCD panels may be driven by a drive mode such that LC molecules in a LC layer, which are aligned in a direction parallel to the LCD panels and rotated by 90 degrees within the LC layer from a surface to an internal thereof, are driven between a light transmission state and a light interception state by an electric field substantially perpendicular to the LCD panels.

In a second aspects the present invention is directed to a liquid crystal display (LCD) device including: a LCD unit displaying a color image and including at least one LCD panel and a light source driven by a dot-matrix drive scheme; and an image-data processing unit receiving input image data to generate output image data for driving the LCD unit, the image-data processing unit including: a monochrome-image generation section for generating monochrome image data based on the input image data to output the monochrome image data to the light source, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the input image data and the monochrome image data to output the color image data to the LCD panels the light source controlling luminance of each dot of pixel in the LCD panel based on the monochrome image data.

In one embodiment of the second aspects the image-data processing unit may further include an arithmetic processing section for performing averaging processing of the monochrome image data generated by the monochrome-image generation section, to output averaged image data to the light source and the image-data generation section.

In another embodiment, the light source may include at least one of light bulb, light emitting diode (LED), organic electro-luminescence (EL), inorganic EL, field emission display (FED), and plasma display panel (PDP).

In a third aspect, the present invention is directed to a liquid crystal display (LCD) system including: a LCD unit including a plurality of LCD panels stacked one on another; and an image-data processing unit for generating image data based on input image data to drive the LCD unit, the plurality of LCD panels including: a first LCD panel and a second LCD panel both including no color filter layer, the image-data processing unit including: a monochrome-image generation section for generating monochrome image data based on the input image data to output the monochrome image data to the second LCD panel, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the input image data and the monochrome image data to output the color image data to the first LCD panel.

In another embodiment, the image-data processing unit may further include an arithmetic processing section for performing averaging processing of the monochrome image data generated by the monochrome-image generation sections to output averaged image data to the second LCD panel and the color-image generation section.

An electronic equipment may include the LCD system according to the first through third aspect of the present invention.

An image-source transfer/adjustment unit may include the LCD system according to the first through third aspect of the present invention.

An image-data switching unit may include the LCD system according to the first through third aspect of the present invention.

An image diagnosis system may include the LCD system according to the first through third aspect of the present invention.

In a fourth aspects the present invention is directed to a liquid crystal display (LCD) system including: a LCD unit including a plurality (n) of LCD panels stacked one on another; an image source unit for generating intermediate image data based on an image source; and an image-data processing unit for generating image data based on the intermediate image data to drive the LCD unit, the plurality of LCD panels including: a first LCD panel including a color filter layer and a second LCD panel including no color filter layer, the image-data processing unit including: a monochrome-image generation section for generating monochrome image data based on the intermediate image data to output the monochrome image data to the second LCD panel, the monochrome image data specifying a full transmission for a first pixel having a luminance or chromaticness which is not less than a threshold, and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the intermediate image data and the monochrome image data to output the color image data to the first LCD panel.

In one embodiment of the fourth aspect, the image source unit may include a signal transmitter for converting the image source into the intermediate image data suited for signal transmission between the transmitter and the image-data processing unit.

In another embodiment, the image-data processing unit may include a timing controller for controlling timing between input of the intermediate image data and input of the monochrome image data to the color-image generation section.

In another embodiment, the image-data processing unit may include a first buffer memory storing therein the color image data output from the color-image generation section and a first transmitter for reading the color image data from the first buffer memory to output the color image data to the first LCD panel, a second buffer memory storing therein the monochrome image data, and a second transmitter for reading the monochrome image data to output the monochrome image data to the second LCD panel.

In one embodiment of the fifth aspect, the image-data processing unit may further include an arithmetic processing section for performing averaging processing of the monochrome image data generated by the monochrome-image generation section, to output averaged image data to the second LCD panel and the color-image generation section.

In another embodiment, the monochrome-image generation section may extract luminance data from the intermediate image data, and generates the monochrome image data based on the extracted luminance data.

In another embodiment, the monochrome-image generation section may select one of a plurality of color image data of each pixels the one having a highest gray-scale level among the color image data of the each pixel in the intermediate image data, to determine a gray-scale level of the each pixel based on the highest gray-scale level.

In another embodiments the monochrome-image generation section may perform at least one of histogram clipping processing, gamma curve conversion processing and histogram enlargement processing.

In another embodiment, the monochrome-image generation section may refer to a lookup table to generate the monochrome image data.

In another embodiment, the lookup table may be a three-dimensional table tabulating a gray-scale level in association with a gray-scale level of each of RGB colors to be specified in the intermediate image data.

In another embodiment, the color-image generation section may refer to a lookup table based on the intermediate image data and the monochrome image data to generate the color image data.

In another embodiment, the lookup table may be a four-dimensional lookup table tabulating a gray-scale level of the color image data for the first LCD panel in association with a gray-scale level of each of RGB colors and gray-scale level of the monochrome image data.

In another embodiment, the color-image generation section may divide a luminance component of the intermediate image data by a luminance of the monochrome image data to generate the color image data.

In another embodiment, the color-image generation section may add an integer not less than one to the luminance of the monochrome image data before the dividing.

In another embodiment, at least one of the monochrome-image generation section and the color-image generation section may be implemented by software.

In another embodiment, the image-data processing unit may include n subsections corresponding to the n LCD panels.

In another embodiment, the n LCD panels each may include an array of three-terminal non-linear devices which drive a corresponding one of the LCD panels in a pseudo-static active matrix driving scheme.

In another embodiment, the n LCD panels each may include an array of two-terminal non-linear devices which drive a corresponding one of the LCD panels in an active-matrix driving scheme.

In a fifth aspect, the present invention is directed to a drive circuit for driving a liquid crystal display (LCD) unit including a first LCD device a second LCD device and a light source arranged in this order from a light emitting side of the LCD unit, the first LCD device including a first LCD panel sandwiched between a pair of first polarizing films, the second LCD device including a second LCD panel sandwiched between a pair of second polarizing films one of the first polarizing films near the second LCD panel and one of the second polarizing films near the first LCD panel having optical axes parallel to one another or being configured by a common polarizing film, wherein:

the drive circuit includes a single input port set for receiving therethrough input image data, an image-data processing unit for generating two sets of output image data by using different algorithms of image processing, and two output port sets for delivering therethrough two sets of output image data for respectively driving the first and second LCD devices.

In one embodiment of the fifth aspect, the drive circuit may be implemented on a single IC chip or a plurality of IC chips to configure image-data controlling chip or chips.

In another embodiment, the image-data processing unit may include a timing controller for controlling timing between the two sets of output image data output to the first and second LCD panels.

In another embodiment, the image-data processing unit includes: a monochrome-image generation section for generating monochrome image data based on input image data to output the monochrome image data to the second LCD device, the monochrome image data specifying a full transmission for a first pixel having a luminance or chromaticness which is not less than a threshold and specifying a first gray-scale level for a second pixel having a luminance or chromaticness which is less than the threshold, the first gray-scale level corresponding to an original gray-scale level of the second pixel specified in the input image data; and a color-image generation section for generating color image data based on the input image data and the monochrome image data to output the color image data to the first LCD device.

While the invention has been particularly shown and described with reference to exemplary embodiment and modifications thereof, the invention is not limited to these embodiment and modifications. It will be understood by those of ordinary skill in the art that various changes in form and details may be made therein without departing from the spirit and scope of the present invention as defined in the claims.

What is claimed is:

1. A liquid crystal display (LCD) system comprising:

a LCD unit displaying a color image and including a plurality (n) of LCD panels stacked one on another; and an image-data processing unit for generating image data based on input data to drive said LCD unit, said plurality of LCD panels including: a first LCD panel including a color filter layer; and a second LCD panel including no color filter layer, said image-data processing unit including: a monochrome-image generation section for generating monochrome image data based on said input image data to output said monochrome image data to said second LCD panel, said monochrome image data specifying a full transmission for a first pixel having a luminance or chromaticness which is not less than a threshold, and specifying a first gray-scale level for a second pixel having a luminance or chromaticness which is less than said threshold, said first gray-scale level corresponding to an original gray-scale level of said second pixel specified in said input image data; and a color-image generation section for generating color image data based on said input image data and said monochrome image data to output said color image data to said first LCD panel.

2. The LCD system according to claim 1, wherein said color image data specifies for said first pixel a second gray-scale level corresponding to an original gray-scale level of said first pixel specified in said input image data, and specifies for said second pixel a third gray-scale level which is corrected from said original gray-scale level of said second pixel specified in said input image data by an amount corresponding to a difference in a transmission factor between said full transmission and a transmission of said first gray-scale level.

3. The LCD system according to claim 1, wherein said color image data specifies that a color of each pixel observed by an observer observing light passing through said first and second LCD panels be an original color of said each pixel s specified in said input image data.

4. The LCD system according to claim 1, wherein said monochrome-image generation section converts said input image data into first monochrome image data, and performs histogram clipping and enlargement of said first monochrome image data to calculate said first gray-scale level.

5. The LCD system according to claim 4, wherein said monochrome-image generation section, upon generation of said first monochrome image data, selects a primary color having a maximum gray-scale level in said input image data among all primary colors, and determines gray-scale levels of said selected primary color as gray-scale levels in said first monochrome image data.

6. The LCD system according to claim 4, wherein said monochrome-image generation section, upon generation of said first monochrome image data, converts said input image data into a HSV color coordinate system to extract a luminance component, and determines a gray-scale level of each pixel based on said extracted luminance component.

7. The LCD system according to claim 4, wherein said monochrome-image generation section, upon generation of said first monochrome image data, selects one of primary colors in said input image data, and determines a gray-scale level of each pixel based on a gray-scale level of said selected one of said primary colors.

8. The LCD system according to claim 4, wherein said monochrome-image generation section, upon generation of said first monochrome image data, selects two of primary colors in said input image data, and determines a gray-scale level of each pixel by performing processing of gray-scales of said selected two of primary colors.

9. The LCD system according to claim 4, wherein said threshold is within a range between 20% and 80% of a transmission factor of said full transmission.

10. The LCD system according to claim 4, wherein said threshold is within a range between 20% and 60% of a transmission factor of said full transmission.

11. The LCD system according to claim 4, wherein said threshold is within a range between 30% and 50% of a transmission factor of said full transmission.

12. The LCD system according to claim 1, wherein each of said plurality of LCD panels other than said first LCD panel includes no color filter layer.

13. The LCD system according to claim 1, wherein said first and second LCD panels have a common pixel resolution.

14. The LCD system according to claim 1, wherein said first LCD panel includes a pixel including three sub-pixels, and said color filter layer includes RGB color filters.

15. The LCD system according to claim 1, wherein said first LCD panel includes a pixel including four to seven sub-pixels, and said color filter layer includes RGB color filters and at least one of yellow, magenta, cyan and transparent filters.

16. The LCD system according to claim 1, wherein said image-data processing unit further includes an arithmetic processing section for performing averaging processing of said monochrome image data generated by said monochrome-image generation section, to output resultant averaged image data to said second LCD panel and said color-image generation section.

17. The LCD system according to claim 16, wherein said arithmetic processing section performs said averaging processing by weighted-averaging of gray-scale levels of adjacent pixels located within a specified distance apart from a subject pixel while using a weighting coefficient which depends on the distance between said adjacent pixels and said subject pixel.

18. The LCD system according to claim 17, wherein said weighting coefficient follows the Gaussian distribution.

19. The LCD system according to claim 16, wherein said arithmetic processing section provides a change of luminance to said monochrome image data without reducing original luminance of said monochrome image data.

20. The LCD system according to claim 19, wherein said arithmetic processing section performs a weighted-averaging processing using a weighting coefficient distribution in a range of ±M pixels and ±N pixels located within a specified distance apart from a subject pixel in an i-th direction and j-th direction, respectively, and performs clipping and enlargement of a histogram of resultant averaged gray-scale levels to thereby provide said change of luminance without reducing original luminance of said monochrome image data.

21. The LCD system according to claim 20, wherein said arithmetic processing section performs weighted-averaging processing of a subject pixel (i,j) having a gray-scale level f(i,j) to generate a weight-averaged gray-scale level g(i,j) by using the following formula:

$$g(i,\ j) = S_{MAX}\left\{\sum_{k=-M}^{M}\sum_{l=-N}^{N} f(i+k,\ j+l)G(i,\ j)/S_{MAX}\right\}^{1/\gamma},$$

where G(i,j), γ and $S_{MAX}$ represent arbitrary weighting factor distribution matrix, gamma value and maximum gray-scale level, respectively.

22. The LCD system according to claim 19, wherein said arithmetic processing section performs weighted-averaging processing using a weighting factor in a range of ±M pixels and ±N pixels apart from said subject pixel in the i-direction and j-direction, respectively, and performs clipping and enlargement of a histogram of resultant averaged gray-scale levels, to thereby change a luminance of pixels without reducing the luminance thereof.

23. The LCD system according to claim 22, wherein said arithmetic processing section performs averaging processing of a subject pixel (i,j) having a gray-scale level f(i,j) to generate a weight-averaged gray-scale level g(i,j) by using the following formula:

$$g(i,\ j) = S_{MAX}\left\{\frac{1}{(2M+1)(2N+1)}\sum_{k=-M}^{M}\sum_{l=-N}^{N} f(i+k,\ j+1)/S_{MAX}\right\}^{1/\gamma},$$

where G(i,j), γ and $S_{MAX}$ represent arbitrary weighting factor distribution matrix, gamma value and maximum gray-scale level, respectively.

24. The LCD system according to claim 19, wherein said arithmetic processing section performs: said averaging processing using a weighting factor in a range of ±M pixels and ±N pixels apart from said subject pixel in the i-direction and j-direction, respectively, to generate weighted-averaged luminance; simple averaging processing of said weight-averaged luminance and luminance of said subject pixel; and clipping and enlargement of a histogram obtained of resultant averaged luminance, to thereby change a luminance of pixels without reducing the luminance thereof.

25. The LCD system according to claim 24, wherein said arithmetic processing section performs averaging processing of a subject pixel (i,j) having a gray-scale level f(i,j) to generate a weight-averaged gray-scale level g(I,j) by using the following formula:

$$g(i,\ j) = S_{MAX}\left\{f(i;k,\ j+l) + \sum_{k=-M}^{M}\sum_{l=-N}^{N} f(i+k,\ j+l)G(i,\ j)/(2S_{MAX})\right\}^{1/\gamma},$$

where G(i,j), γ and $S_{MAX}$ represent arbitrary weighting factor distribution matrix, gamma value and maximum gray-scale level, respectively.

26. The LCD system according to claim 1, wherein said LCD panels each have a number (m) of gray-scale levels, and said LCD unit has a number of a gray-scale levels which is not less than m and not larger than $m^n$.

27. The LCD system according to claim 1, wherein said LCD panels are driven by a drive mode such that LC molecules aligned in a direction parallel to said LCD panels are driven between a light transmission state and a light interception state by an electric field substantially parallel to said LCD panels.

28. The LCD system according to claim 1, wherein said LCD panels are driven by a drive mode such that LC molecules aligned in a direction perpendicular to said LCD panels are driven between a light transmission state and a light interception state by an electric field substantially perpendicular to said LCD panels.

29. The LCD system according to claim 1, wherein said LCD panels are driven by a drive mode such that LC molecules in a LC layer, which are aligned in a direction parallel to said LCD panels and rotated by 90 degrees within said LC layer from a surface to an internal thereof, are driven between a light transmission state and a light interception state by an electric field substantially perpendicular to said LCD panels.

* * * * *